US011101907B2

(12) United States Patent
Curinga et al.

(10) Patent No.: US 11,101,907 B2
(45) Date of Patent: Aug. 24, 2021

(54) OUTPUT POWER DETERMINATION FOR OPTIMAL RADIO SIGNAL TRANSMISSION

(71) Applicant: H&E SOLUTIONS AB, Sundbyberg (SE)

(72) Inventors: Florian Curinga, Järfälla (SE); Mikael Erneberg, Sundbyberg (SE); Alex Hedberg, Trångsund (SE)

(73) Assignee: H&E SOLUTIONS AB, Sundbyberg (SE)

( * ) Notice: Subject to any disclaimer, the term of this patent is extended or adjusted under 35 U.S.C. 154(b) by 0 days.

(21) Appl. No.: 16/980,650

(22) PCT Filed: Mar. 15, 2019

(86) PCT No.: PCT/SE2019/050236

§ 371 (c)(1),
(2) Date: Sep. 14, 2020

(87) PCT Pub. No.: WO2019/177531

PCT Pub. Date: Sep. 19, 2019

(65) Prior Publication Data

US 2021/0021357 A1 Jan. 21, 2021

(30) Foreign Application Priority Data

Mar. 15, 2018 (EP) ..... 18162085

(51) Int. Cl.
*H04H 20/55* (2008.01)
*H04H 20/59* (2008.01)
(Continued)

(52) U.S. Cl.
CPC ..... *H04H 20/55* (2013.01); *H04H 20/59* (2013.01); *H04H 20/72* (2013.01); *H04H 60/42* (2013.01); *H04H 60/43* (2013.01); *H04H 60/51* (2013.01)

(58) Field of Classification Search
CPC ..... H04H 20/55; H04H 20/59; H04H 20/72; H04H 60/41; H04H 60/42; H04H 60/43; H04H 60/51
(Continued)

(56) References Cited

U.S. PATENT DOCUMENTS

2003/0063015 A1 4/2003 Ebner et al.
2005/0134440 A1 6/2005 Breed
(Continued)

FOREIGN PATENT DOCUMENTS

EP 1410361 A1 4/2004
JP 2010118731 A 5/2010
(Continued)

OTHER PUBLICATIONS

H&E Solutions AB, European Application No. 18162085.7, Extended European Search Report, dated Oct. 2, 2018.
(Continued)

*Primary Examiner* — Tan H Trinh
(74) *Attorney, Agent, or Firm* — Moore & Van Allen PLLC; W. Kevin Ransom

(57) ABSTRACT

Disclosed is a system and method for determining output transmission power for radio signal transmission, from an interception transmitter and from an announcement transmitter, respectively, to at least one announcement receiver, wherein each announcement receiver is in a respective motor vehicle, the method comprising: receiving an input signal to be suppressed; determining a first field strength of the input signal, at a first frequency $f_I$, at a position $POS_R$; determining a first transmission power of a first radio signal, intended to be transmitted by the interception transmitter, needed to suppress the input signal at an interception transmission distance; determining a second field strength of at least one of atmospheric noise and the input signal at a second frequency $f_A$, at the position POSR; and determining a second transmission power of second radio signal comprising an announcement to be transmitted by the announcement transmitter to the at least one announcement receiver.

19 Claims, 8 Drawing Sheets

(51) Int. Cl.

| | |
|---|---|
| ***H04H 20/72*** | (2008.01) |
| ***H04H 60/42*** | (2008.01) |
| ***H04H 60/43*** | (2008.01) |
| ***H04H 60/51*** | (2008.01) |

(58) Field of Classification Search
USPC ..... 455/69, 522, 41.2, 420, 441, 440, 452.2
See application file for complete search history.

(56) References Cited

U.S. PATENT DOCUMENTS

| | | | | |
|---|---|---|---|---|
| 2010/0291906 | A1* | 11/2010 | DeLuca | H04K 3/80 455/414.1 |
| 2013/0227689 | A1* | 8/2013 | Pietrowicz | H04L 41/12 726/23 |
| 2015/0371538 | A1 | 12/2015 | Eichhorst | |
| 2017/0242144 | A1* | 8/2017 | Brizard | G01V 1/3808 |
| 2017/0299633 | A1* | 10/2017 | Pietrowicz | H04L 63/1416 |

FOREIGN PATENT DOCUMENTS

| | | | |
|---|---|---|---|
| WO | 02103653 | A1 | 12/2002 |
| WO | 2006138364 | A2 | 12/2006 |
| WO | 2015054489 | A1 | 4/2015 |

OTHER PUBLICATIONS

H&E Solutions AB, International Application No. PCT/SE2019/050236, International Search Report, dated Jun. 12, 2019.
H&E Solutions AB, International Application No. PCT/SE2019/050236, Written Opinion, dated Jun. 12, 2019.

* cited by examiner

OUTPUT POWER DETERMINATION FOR OPTIMAL RADIO SIGNAL TRANSMISSION

CROSS-REFERENCE TO RELATED APPLICATIONS

This application is a national stage application (filed under 35 § U.S.C. 371) of PCT/SE2019/050236, filed Mar. 15, 2019 of the same title, which, in turn claims priority to European Patent Application No. 18162085.7, filed Mar. 15, 2018 of the same title; the contents of each of which are hereby incorporated by reference.

TECHNICAL FIELD

The present disclosure relates to a system and method for determining output transmission power for optimal radio signal transmission.

Specifically, there is disclosed a system and method for determining output transmission power for optimizing radio signal transmission, when transmitting an announcement of a local traffic event to radio receivers in nearby vehicles.

BACKGROUND

Emergency vehicles such as ambulances, police and others, have made use of acoustic and visual alarming since many years, including for example sirens, blue and/or red lights etc. In the past years, vehicles have become better isolated which results in a driver of the vehicle less easily recognizing a siren, furthermore audio devices in vehicles have become better and able to produce louder sounds. At the same time, traffic has become denser. Furthermore, mobile telephony and associated hands free transmission in vehicles also tend to deviate the attention of the driver from any outside signalling such as from an emergency vehicle. These factors together may have resulted in the past years in for one thing more and more difficulties for a staff of an emergency vehicle to reach a desired destination in due time, and further that accidents may be more prone to happen due to the road occupants not noticing an alarm regarding a traffic event in time.

Attempts have been made to signal drivers of vehicles by means of radio transmission, so as to make them aware of an approaching emergency vehicle. Thereby, use has been made of a radio transmitter which transmits a radio wave in a public radio broadcasting frequency band, so as to warn a driver that has switched on the radio receiver in the vehicle.

These solutions have however until now been unsatisfactory given the many possible frequencies to which a radio receiver could be tuned. Taking the FM band as an example, a frequency band is assigned reaching from 87.5-108 MHz. In this frequency band, a spacing of for example 100 kHz, may be applied. In dense regions, a frequency spacing may even be reduced to 50 kHz between stations. Thereby, referring to the example of the FM band, different stations may transmit at roughly 200-400 different frequencies within this band. An emergency vehicle approaching a traffic situation, would want to provide alarm signals to drivers of different vehicles, each of which may have the radio tuned to a different frequency. In order to warn a driver sufficiently early to provide any benefit at all, a warning would have to be transmitted at each respective frequency within seconds or an even shorter time frame. As a result, in order to be able to warn drivers at each possible frequency, hundreds of possible frequencies would have to be covered by warning device virtually simultaneously. Furthermore, at each of the frequencies, a signal would have to be transmitted for a sufficient long time to allow the driver to be aware of the situation, which practical implementations have appeared to fail for the reasons cited above. Furthermore, it is to be noted that emergency vehicles such as ambulances are normally equipped with a large range of electronic devices such as medical measurement equipment, medical patient surveillance equipment, communication equipment, etc., which would risk to be disturbed by a radio wave transmitter that would transmit radio signals at each of the above referenced hundreds of frequencies within the referred frequency band. This may especially be the case, as a transmission power of the radio wave transmitter would have to be sufficiently high at each of the frequencies to "push away" or suppress a regular transmission of a radio station at such frequency.

Furthermore, national and regional regulatory frameworks hinder such a broad transmission approach, using "all" or a large number of frequencies simultaneously. For example, the regulations may typically include something regarding that the radio frequencies may not be used in a manner that risks unauthorized harmful interference, and further that the radio use is an efficient use of the frequency area.

There exists a need for an improved solution. Embodiments presented herein aim at overcoming or at least ameliorating the disadvantageous described above.

SUMMARY

According to a first aspect, there is provided a system for determining output transmission power for radio signal transmission, the system comprising at least a data processor. The data processor is communicatively coupled to: an announcement transmitter; an interception transmitter; an input signal receiver that is configured to relay to the data processor an input signal to be suppressed; and at least one announcement receiver, wherein each of the at least one announcement receiver is comprised in a respective motor vehicle. Each of the at least one announcement receiver is configured to: receive a first radio signal from the interception transmitter; and receive a second radio signal from the announcement transmitter. The data processor is configured to: obtain a position of the announcement transmitter; determine a current velocity of the announcement transmitter; for each announcement receiver of the at least one announcement receiver:estimate a current velocity of the motor vehicle comprising the announcement receiver; determine a relative velocity between the announcement transmitter and the motor vehicle comprising the announcement receiver, based on the current velocities and; determine an interception transmission distance, based on a preset warning time, a looping time and the relative velocity; determine an announcement transmission distance, based on a preset announcement time indicative of the length of the announcement to be transmitted, the relative velocity and the interception transmission distance, wherein the announcement transmission distance is greater than the interception transmission distance; and estimate a position of the motor vehicle comprising the announcement receiver. The data processor is further configured to: receive, from the input signal receiver, an input signal; determine a first field strength of the input signal, at a first frequency, at the position; and determine a first transmission power of the first radio signal needed to suppress the input signal at the interception transmission distance, wherein determining a first transmission power of the first radio signal based on at least one of: the interception transmission distance; the attenuation of a transmitted radio signal over the interception transmission distance; the first field strength, of the input signal at the position of the motor vehicle comprising the announcement receiver; and a predetermined suppression level. The data processor is further configured to: determine a second field strength of at least one of atmospheric noise received from the input signal receiver; and the input signal at a second frequency, at the position of the motor vehicle comprising the announcement receiver; and determine a second transmission power of the second radio signal, based on at least one of: the announcement transmission distance; the attenuation of a transmitted radio signal over the announcement transmission distance; the second field strength; and a predetermined signal quality threshold value.

According to a second aspect, there is provided a method for determining output transmission power for radio signal transmission, from an interception transmitter and from an announcement transmitter, respectively, to at least one announcement receiver, wherein each announcement receiver is comprised in a respective motor vehicle, the method comprising: obtaining, by a data processor communicatively coupled to the announcement transmitter and the interception transmitter, a position of the announcement transmitter; determining, by the data processor, a current velocity of the announcement transmitter; for each of the at least one announcement receiver: estimating, by the data processor, a current velocity of the motor vehicle comprising the announcement receiver; determining, by the data processor, a relative velocity between the announcement transmitter and the motor vehicle comprising the announcement receiver, based on the current velocities and; determining, by the data processor, an interception transmission distance, based on a preset warning time, a looping time and the relative velocity; and determining, by the data processor, an announcement transmission distance, based on a preset announcement time indicative of the length of the announcement to be transmitted, the relative velocity and the interception transmission distance, wherein the announcement transmission distance is greater than the interception transmission distance; estimating a position of the motor vehicle comprising the announcement receiver; receiving from an input signal receiver, in the data processor, an input signal; determining, by the receiver or the data processor, a first field strength of the input signal, at a first frequency, at the position of the motor vehicle comprising the announcement receiver; determining, by the data processor, a first transmission power of the first radio signal needed to suppress the input signal at the interception transmission distance, based on at least one of: the interception transmission distance; the attenuation of a transmitted radio signal over the interception transmission distance; the first field strength of the input signal; and a predetermined suppression level; determining, by the data processor, a second field strength of at least one of: atmospheric noise received from the input signal receiver; and the input signal, at a second frequency, at the position; and determining, by the data processor, a second transmission power of second radio signal, based on at least one of: the announcement transmission distance; the attenuation of a transmitted radio signal over the announcement transmission distance; and the second field strength; and a predetermined signal quality threshold value.

The method may further comprise, in the interception transmitter: receiving a first control signal indicative of the first transmission power from the data processor; and in response to receiving the first control signal, transmit a first radio signal to at least one announcement receiver at the first transmission power.

The method may further comprise, in the announcement transmitter: receiving a second control signal indicative of the second transmission power from the data processor; and in response to receiving the second control signal, transmit a second radio signal to at least one announcement receiver at the second transmission power.

According to a third aspect, there is provided a method for generating or updating a frequency spectrum data database for use in any of the embodiments of the method for determining output transmission power for radio signal transmission, the method comprising: a) determining the current position of the announcement transmitter, and b) determining if there is a radio frequency spectrum available in a frequency spectrum data database for the current position. If no frequency data database has been previously generated or stored, the method comprises initiating a frequency data database and continuing to step c). If a frequency data database exists and there is a radio frequency spectrum available for the current position in the frequency data database, the method comprises returning to step a). If a frequency data database exists and there is no radio frequency spectrum available for the current position in the frequency data database, the method comprises continuing to step c). Step c) comprises scanning a frequency spectrum area available at the position for field strength data associated with the frequency spectrum area, using the input signal receiver; and step d) comprises, for each frequency in the frequency spectrum or frequency spectrum area, storing in the frequency spectrum data database the frequency together with its associated field strength value and the current position.

According to a fourth aspect, there is provided a computer program loadable into a memory communicatively connected or coupled to at least one data processor, comprising software for executing the method according any of the embodiments of the method for determining output transmission power for radio signal transmission, when the program is run on the at least one data processor.

According to a fifth aspect, there is provided a processor-readable medium, having a program recorded thereon, where the program is to make at least one data processor execute the method according to of any of the embodiments of the method for determining output transmission power for radio signal transmission, when the program is loaded into the at least one data processor.

BRIEF DESCRIPTION OF THE DRAWINGS

The invention is now to be explained more closely by means of preferred embodiments, which are disclosed as examples, and with reference to the attached drawings.

DETAILED DESCRIPTION

Introduction

Figure 1:
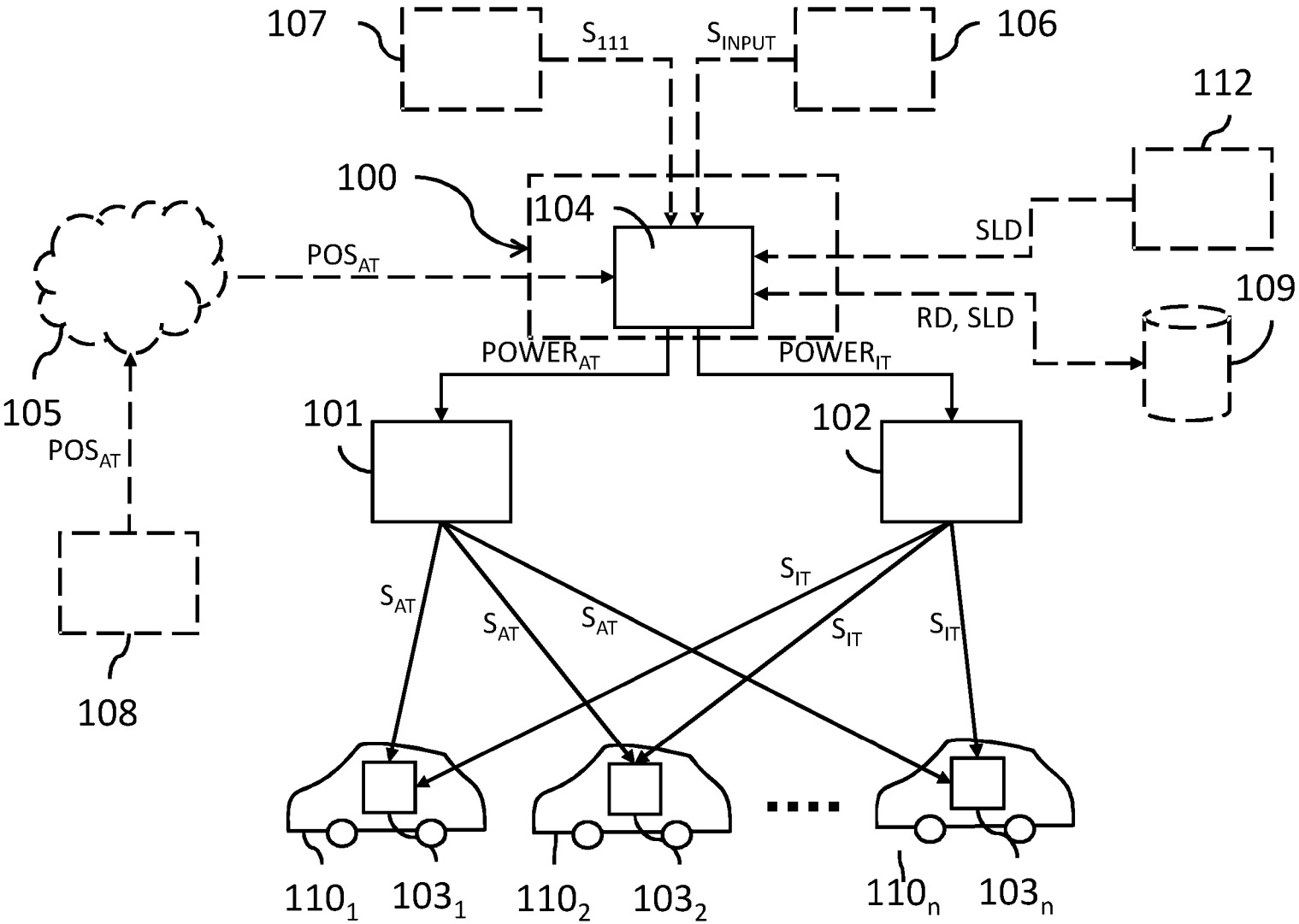
FIG. 1 shows a schematic overview of a system according to one or more embodiments.

In an alarm situation relating to a traffic event such as an emergency vehicle approaching, an accident on the road ahead, or anything else that alters the traffic situation and requires a driver's attention, it is of importance to make sure that the driver of a radio signal receiving vehicle receives a warning message or alarm more than a set minimum time, the warning time, before the warning vehicle arrives, or before the receiving vehicle arrives to the warning vehicle or traffic event. This means that the preset warning time, below referred to as $T_W$, is indicative of the minimum time from the time instance that an announcement receiver in a vehicle of a person to be warned starts to receive the warning message until the time instance that the vehicle with the announcement receiver arrives at the traffic event, or the warning vehicle arrives at the position of vehicle with the announcement receiver. In other words, as defined herein, the preset warning time is indicative of the minimum time from the time instance that the announcement receiver receives a second radio signal $S_{AT}$, comprising the warning message or announcement, until the time instance that the position of the announcement receiver corresponds to (or is sufficiently close to, for example within a preset threshold distance of) the position of the announcement transmitter sending the second radio signal $S_{AT}$. As some non-limiting examples, the warning time may be preset to between 5 and 20 seconds, in some instances around 10 seconds, depending on circumstances. According to these examples, the warning message starts to play from the radio of the vehicle comprising the announcement receiver somewhere between 5 and 20 seconds before the positions of the announcement receiver vehicle and the traffic event/emergency vehicle are estimated to coincide.

It is also of importance that the audio quality/integrity of the warning message or alarm transmitted is ensured at the receiver end, and that it is not compromised by for example the receiver/the receiving vehicle being near the periphery of the area of transmission of the warning message or announcement.

A further aspect is that national and regional regulations must be fulfilled in order for radio signal transmission on the AM or FM band to be allowed.

Embodiments presented herein achieve one or more of these aims by enabling dual transmission areas, wherein the first is a transmission area for sending an interception signal, or first radio signal, to suppress or override any radio signal presently transmitted in the first area, and wherein the second is the transmission area for sending an announcement signal, or second radio signal, comprising an announcement or alarm to be received by at least one announcement receiver. The aim of embodiments presented herein is to enable transmission of an announcement signal to the at least one announcement receiver within a preset warning time and at least at a predetermined lowest quality level, thereby enabling that a driver of a vehicle comprising an announcement receiver can hear the announcement clearly, and further hears it in time to react appropriately in response to the announcement, for example by slowing down in the case of an upcoming accident or road work, or pull over if an emergency vehicle is approaching. In one or more embodiments, the warning time is set to the estimated minimum time that passes from the time that an announcement receiver first receives the announcement signal to the time when the vehicle comprising the announcement receiver arrives at the location of the traffic event to which the announcement relates. In this context, the vehicle comprising the announcement receiver arriving at the location of the traffic event to which the announcement relates also includes the case where an approaching emergency vehicle arrives at the location of the vehicle comprising the announcement receiver. As a non-limiting example, the warning time may be between 5 and 20 seconds, and in some cases between 10 and 15 seconds, but other warning times are of course also applicable.

In order to achieve this aim, embodiments presented herein enable controlling the output power of the transmission of the first and second radio signal, on which the size of the respective transmission areas are dependent, such that the first transmission area is enclosed by the second transmission area in such a way that a vehicle comprising an announcement receiver will not have time to, from receiving the interception signal, or first radio signal, travel such a distance that it leaves the larger second transmission area, i.e. the area in which announcement signal, or second radio signal, is transmitted, before the entire announcement has been received. This is described further herein, in connection with the figures.

In signal communications, particularly using radio frequency signal transmission, signal strength or field strength refers to the transmitter power output as received by a reference antenna at a distance from the transmitting antenna, or any variable or combination of variables describing the received power of a specific radio frequency signal. The terms signal strength, field strength and output power may hereinafter be used interchangeably within the context of embodiments presented herein.

Transmission of a radio signal is in the context of the present disclosure to be understood as any, or a combination, of: broadcasting, multicasting or unicasting.

System Architecture

Below, embodiments of the inventive system are described in more detail, with reference to FIGS. 1 and 2A to 2C.

In the context of the present disclosure, system parts being communicatively coupled is understood as the system parts either being integrated in same device (e.g. in an emergency vehicle, any other motor vehicle, in a traffic signage, in an antenna etc.), or implemented as separate devices communicating over a network, which network may be wired or wireless according to any suitable technology known in the art.

FIG. 1 shows a system 100, according to embodiments of the invention, for determining output transmission power for radio signal transmission, the system 100 comprising a data processor 104. The data processor 104 is communicatively coupled to at least one announcement transmitter 101; at least one interception transmitter 102; at least one input signal receiver 107 that is configured to relay to the data processor 104 an input signal $S_{111}$ to be suppressed; and at least one announcement receiver $\mathbf{103}_1 \ldots \mathbf{103}_n$. In some embodiments, the at least one announcement transmitter 101 and/or the at least one interception transmitter 102 are integrated parts of the system 100.

Hereinafter, for illustrative purposes, the system and method embodiments will be described in relation to a single interception transmitter 102 and a single announcement transmitter 101, but more than one of either transmitter is equally applicable. Furthermore, for illustrative purposes, the system and method embodiments will be described in relation to a single input signal receiver 107, but more than one is equally applicable. The input signal $S_{111}$ may be transmitted by, and hence received from, an input signal source 111, which may be any kind of radio frequency transmitting antenna/base station/device etc.

The at least one interception transmitter 102 is configured to transmit a first radio signal $S_{IT}$, herein also referred to as an interception signal $S_{IT}$, to one or more of the at least one announcement receiver $\mathbf{103}_1 \ldots \mathbf{103}_n$. The at least one announcement transmitter 101 is configured to transmit a second radio signal $S_{AT}$, herein also referred to as an announcement signal $S_{AT}$, to the same one or more of the at least one announcement receiver $\mathbf{103}_1 \ldots \mathbf{103}_n$.

In some embodiments, the one or more of the at least one announcement receiver $\mathbf{103}_1 \ldots \mathbf{103}_n$ to which the first radio signal $S_{IT}$ and the second radio signal $S_{AT}$ are transmitted are the announcement receivers $\mathbf{103}_1 \ldots \mathbf{103}_n$ which are present within a transmission area $A_E$. The transmission area $A_E$ and calculation of the same are further described in connection with FIGS. 2A to 2C. In some embodiments, one or more of the at least one interception transmitter 102 and one or more of the at least one announcement transmitter 101 may be integrated into or implemented in a single transmitter or transceiver device (not shown in the figure). In some embodiments, also one or more of the at least one input signal receiver 107 may be integrated into or implemented the same transceiver device as one or more of the at least one interception transmitter 102 and/or one or more of the at least one announcement transmitter 101.

According to different embodiments, the announcement transmitter 101 and/or the interception transmitter 102 may be incorporated in mobile or stationary motor vehicle, e.g. an emergency vehicle or other motor vehicle related to a traffic event requiring particular attention from the nearby road occupants to ensure road safety, a road signage, another stationary installation in the vicinity of a road, etc.

Figure 2A:
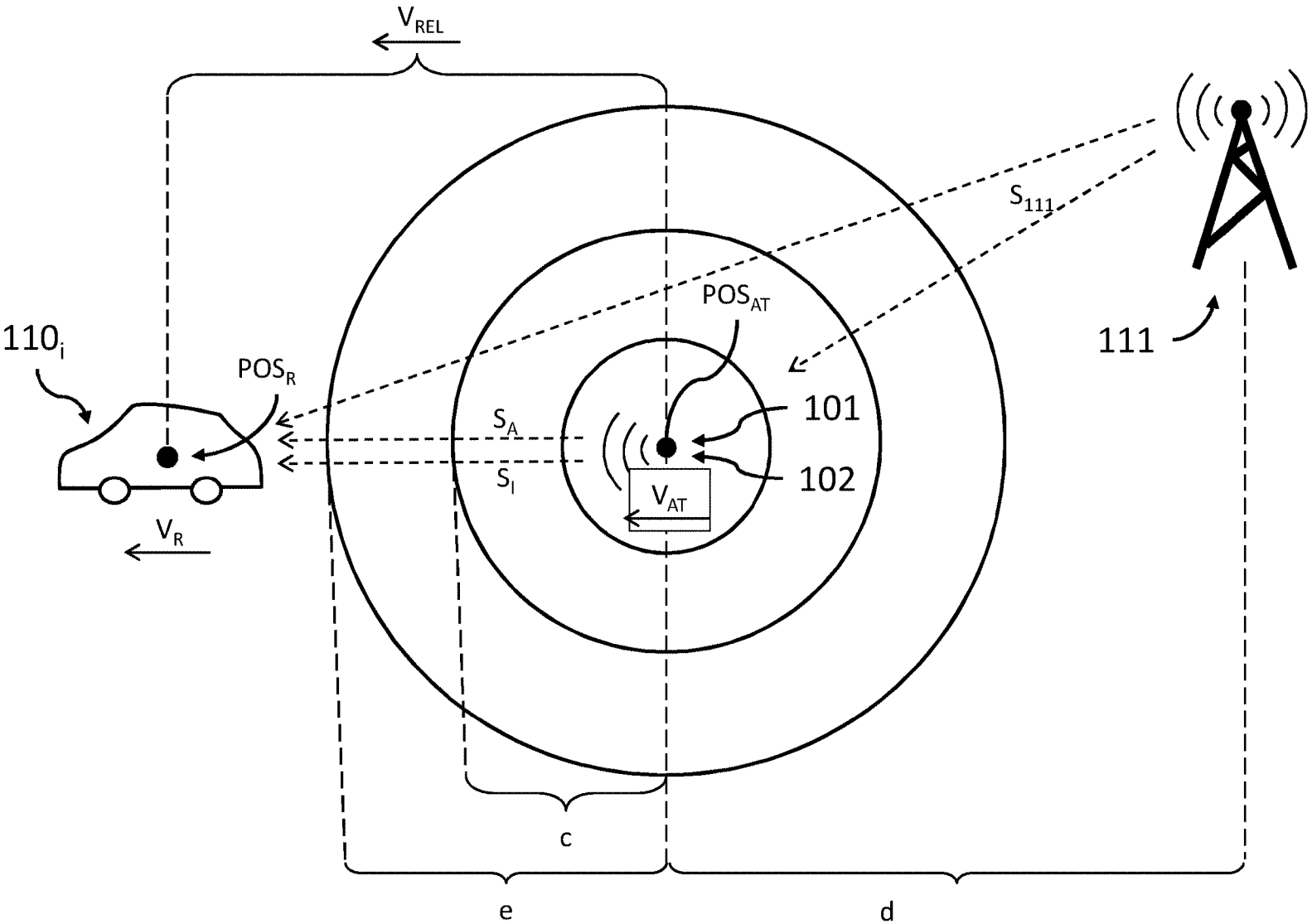
FIGS. 2A to 2C schematically illustrate parameters used for optimizing output transmission power according to some embodiments.

As illustrated in FIG. 2A, each of the at least one announcement receiver $\mathbf{103}_1 \ldots \mathbf{103}_n$ may be comprised in a respective motor vehicle 110, and configured to receive radio signals, such as the first radio signal $S_{IT}$ from the interception transmitter 102 and the second radio signal $S_{AT}$ from the announcement transmitter 101. Each motor vehicle 110 in which at least one announcement receiver $\mathbf{103}_1 \ldots \mathbf{103}_n$ is comprised may be any kind of motor vehicle, e.g. a car, a truck, a motorcycle, a moped, or any kind of emergency vehicle etc.

Turning again to the system 100 of FIG. 1, the data processor 104 may be configured to obtain a position $POS_{AT}$ of the announcement transmitter 101. In some embodiments, the data processor 104 may be configured to obtain the position $POS_{AT}$ of the announcement transmitter 101 from a position determination unit 108. In some embodiments, the position determination unit 108 may be integrated in the system 100. In other embodiments, the position determination unit may be external to the system 100 and communicatively coupled to the data processor 104. The position determination unit 108 may be communicatively coupled to the data processor 104 via any known wired or wireless communication link or channel. In one non-limiting exemplary embodiment, the position determination unit 108 is communicatively coupled to the data processor 104 via a wireless network 105, as illustrated in FIG. 1. The position determination unit may use global positioning system (GPS) technology, but is not limited to this.

The data processor 104 may be configured to determine a current velocity $V_{AT}$ of the announcement transmitter 101. The data processor 104 may in some embodiments be configured to determine the current velocity $V_{AT}$ of the announcement transmitter 101 based on information from the position determination unit 108. The position determination may in this case for instance be a global positioning system GPS. Alternatively, or in combination with this option, if the announcement transmitter 101 is located in or on a vehicle, data processor 104 may be configured to determine the current velocity $V_{AT}$ of the announcement transmitter 101 based on information from an On-Board-Diagnostics (OBD) port of the vehicle, and/or from a sensor on the Controller Area Network (CAN bus) system of the vehicle. In some embodiments, the announcement transmitter 101 may located in or on, or integrated in, an object such as a road signage or the like, whereby the current velocity $V_{AT}$ of the announcement transmitter 101 will be determined to be zero. The velocity may in this case be determined during operation, by the data processor 104, or may be predetermined and retrieved by or accessible to the data processor 104.

Figure 6:
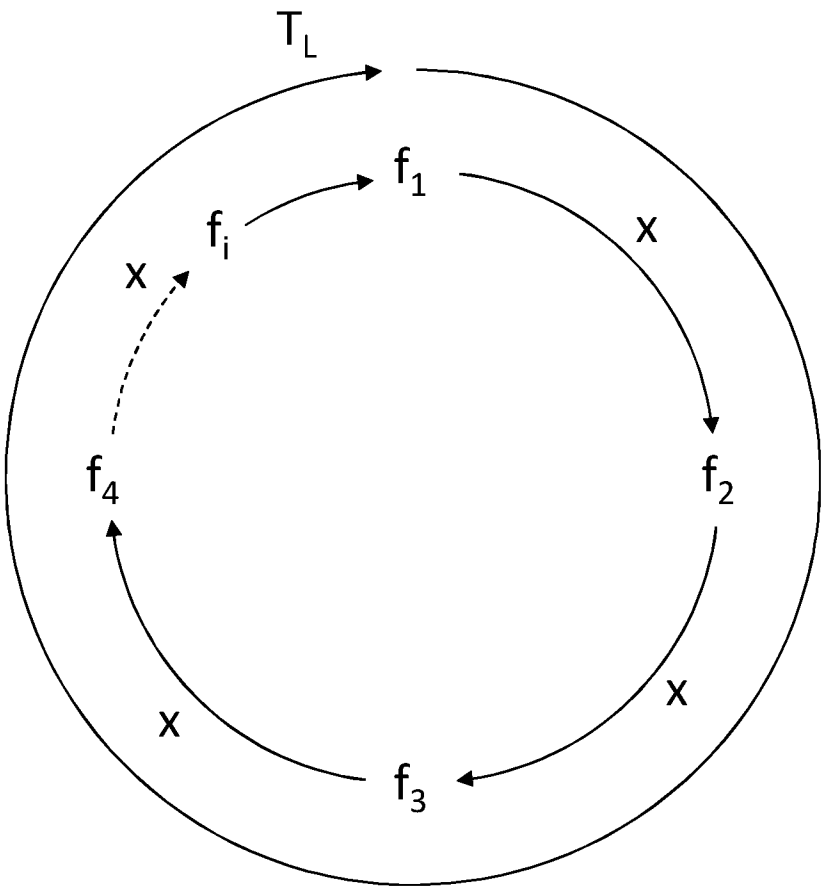
FIG. 6 shows an example of the calculation of a time $T_L$ for an interception transmitter 120 according to one or more embodiments.

The data processor 104 may further be configured to, for each announcement receiver $\mathbf{103}_i$ of the at least one announcement receiver $\mathbf{103}_1 \ldots \mathbf{103}_n$: estimate a current velocity $V_R$ of the motor vehicle $\mathbf{110}_i$ comprising the announcement receiver $\mathbf{103}_i$; determine a relative velocity $V_{REL}$ between the announcement transmitter 101 and the motor vehicle $\mathbf{110}_i$ comprising the announcement receiver $\mathbf{103}_i$, based on the current velocities $V_{AT}$ and $V_R$; determine an interception transmission distance c, based on a preset warning time $T_W$, a looping time $T_L$, which is further described in connection with FIG. 6, and the relative velocity $V_{REL}$; determine an announcement transmission distance e, based on a preset announcement time $T_A$ indicative of the length of the announcement to be transmitted, the relative velocity $V_{REL}$ and the interception transmission distance c, wherein the announcement transmission distance e is greater than the interception transmission distance c; and estimate a position $POS_R$ of the motor vehicle $\mathbf{110}_1 \ldots \mathbf{110}_n$ comprising the announcement receiver $\mathbf{103}_1 \ldots \mathbf{103}_n$.

In one or more embodiments, the interception distance c is determined according to the following relation:

$$c=(T_W+T_L)*V_{REL}$$

In one or more embodiments, the announcement transmission distance e is determined according to the following relation:

$$e=c+T_A*V_{REL}$$

That the preset announcement time $T_A$ is indicative of the length of the announcement to be transmitted means that it corresponds to the length of the announcement, i.e. the time it takes to play the announcement, or corresponds to a an appropriate approximation of the length of the announcement. An appropriate approximation of the length of the announcement may e.g. be a slightly longer time than the actual length of the announcement, to be sure that the entire announcement is played during that time. In an example, $T_A$ corresponds to the time it takes to play a recorded message such as: "Warning, emergency vehicle approaching", or slightly longer than that time.

In one or more embodiments, the data processor 104 is configured to: receive, from the input signal receiver 107, an input signal $S_{111}$; determine a first field strength $FS_I$ of the input signal $S_{111}$, at a first frequency $f_I$, at the position $POS_R$; and determine a first transmission power $POWER_{IT}$ of the first radio signal $S_{IT}$ needed to suppress the input signal $S_{111}$ at the interception transmission distance c. The data processor 104 may be configured to determine the first transmission power $POWER_{IT}$ based on at least one of: the interception transmission distance c; the attenuation of a transmitted radio signal over the interception transmission distance c; the first field strength $FS_I$ of the input signal $S_{111}$ at $POS_R$; and a predetermined suppression level.

In one or more embodiments, the data processor 104 is configured to determine a second field strength $FS_A$ of at least one of atmospheric noise received from the input signal receiver 107, and the input signal $S_{111}$ and at a second frequency $f_A$, at the position $POS_R$. The data processor 104 may in these embodiments be configured to determine a second transmission power $POWER_{AT}$ of the second radio signal $S_{AT}$, based on at least one of: the announcement transmission distance e; the attenuation of a transmitted radio signal over the announcement transmission distance e; the second field strength $FS_A$; and a predetermined signal quality threshold value Q.

The data processor may be configured to select the first frequency and/or second frequency $f_I$,$f_A$, and/or determine any of first field strength $FS_I$, the first transmission power $POWER_{IT}$, the second field strength $FS_A$ and the second transmission power $POWER_{AT}$ according to any of the method steps or functions described in connection with FIG. 4.

By determining the first and second transmission powers $POWER_{IT}$, $POWER_{AT}$, transmission is enabled over dual transmission areas, wherein the first is a transmission area $A_C$ for sending an interception signal $S_{IT}$, or first radio signal, to suppress or override any radio signal presently transmitted in the first area, and wherein the second is the transmission area $A_E$ for sending an announcement signal, or second radio signal, $S_{IT}$ comprising an announcement or alarm to be received by at least one announcement receiver 101. Furthermore, there is enabled transmission of an announcement signal $S_{AT}$ to the at least one announcement receiver 101 within a preset warning time $T_W$ and at least at a predetermined lowest quality level Q, thereby enabling that a driver of a vehicle comprising an announcement receiver 101 can hear the announcement clearly, and further hears it in time to react appropriately in response to the announcement, for example by slowing down in the case of an upcoming accident or road work, or pull over if an emergency vehicle is approaching. This is achieved since the disclosed embodiments enable controlling the output power of the transmission of the first and second radio signal $S_{IT}$, $S_{AT}$, on which the size of the respective transmission areas $A_C$, $A_E$ are dependent, such a that the first transmission area $A_C$ is enclosed by the second transmission area $A_E$ in such a way that a vehicle 110 comprising an announcement receiver 101 will not have time to, from receiving the interception signal, or first radio signal, $S_{IT}$ travel such a distance that it leaves the larger second transmission area $A_E$, i.e. the area in which the announcement signal, or the second radio signal, $S_{AT}$ is transmitted, before the entire announcement has been received.

Further advantageous, optional, embodiments are now described.

In one or more embodiments, the system 100 is configured to repeatedly determine a second transmission power $POWER_{AT}$ of the announcement transmitter 101. This includes the data processor 104 being configured to repeatedly perform the functions described herein in connection with the data processor 104, and each of the at least one announcement receiver $\mathbf{103}_1 \ldots \mathbf{103}_n$ being configured to repeatedly perform the functions described herein in connection with at least one announcement receiver $\mathbf{103}_1 \ldots \mathbf{103}_n$.

The data processor 104 may be configured to estimate the current velocity $V_R$ of the motor vehicle comprising the announcement receiver based at least on the current velocity $V_{AT}$ of the announcement transmitter.

The data processor 104 may be configured to obtain speed limit data, SLD, indicative of the speed limit associated with the position $POS_{AT}$ of the announcement transmitter 101 and estimate the current velocity $V_R$ of the motor vehicle $\mathbf{110}_1 \ldots \mathbf{110}_n$ comprising the announcement receiver $\mathbf{103}_1 \ldots \mathbf{103}_n$ based at least on the obtained speed limit data SLD.

The system 100 may comprise a road data database 109 configured to store road data RD comprising SLD, wherein the data processor 104 may further be configured to obtain the SLD from the road data database 109. The system 100 may comprise or be communicatively coupled to the road data database 109. In some embodiments, the system 100 may be communicatively coupled to a road data database 109, as exemplified in FIG. 1. This may be implemented by the data processor 104 being communicatively coupled to the road data database 109, for example via a wired or wireless network (not shown in the figure). In other embodiments, the road data database 109 may be an integrated part/unit of the system 100. The road data may according to different embodiments comprise a selection of for instance road type, speed limit information of a road or road section, and/or the average speed of vehicles travelling the road or road section. The road data may, in one or more embodiments, be geo-tagged or otherwise associated with location information.

The system 100 may comprise an imaging device 112 configured to: capture an image of the surroundings of the announcement transmitter 101; analyze the captured image to determine if there is a sign showing a speed limit depicted in the image, using image processing; and if there is a sign showing a speed limit depicted in the image, determine the speed limit shown and generate the SLD based on the determined speed limit.

Figure 2B:
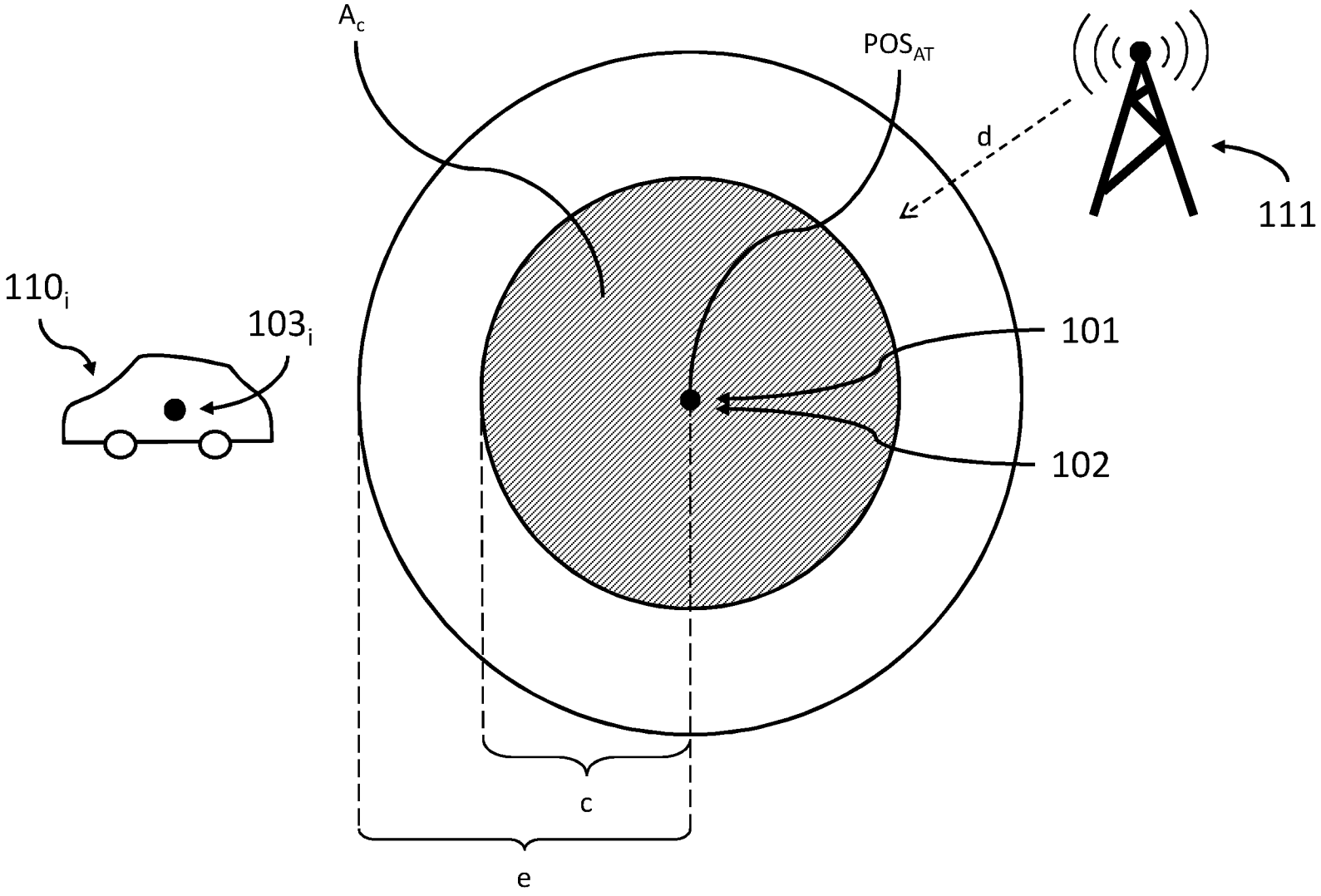

Turning now to FIG. 2B, the interception transmitter 102 may be configured to transmit the first radio signal/interception signal $S_{IT}$ across area $A_C$, which may also be referred to as the interception area $A_C$, which is illustrated by the striped area in the example of FIG. 2B. Similarly, the announcement transmitter 101 may be configured to transmit a warning message or announcement, in the form of the second radio signal $S_{AT}$, across area $A_E$, which may also be referred to as the announcement area $A_E$, which is illustrated by the dotted area in the example of FIG. 2C. In the non-limiting examples of FIGS. 2A, 2B and 2C, the transmission areas $A_C$, $A_E$ are illustrated as being symmetrical and concentric. This is the case achieved if both the announcement transmitter 101 and the interception transmitter 102 are configured to transmit unidirectional. In these cases, the interception transmission distance c will correspond to the radius of the interception area $A_C$ and the announcement transmission distance e will correspond to the radius of the announcement area $A_E$, as can be seen from FIGS. 2B and 2C.

However, the transmission of the interception transmitter 102 and the announcement transmitter 101 can be of any shape, including, but not limited to, unidirectional transmission or directional transmission. In such cases, the interception transmission distance c may correspond to the distance from the position $POS_{AT}$ of the announcement transmitter 101 to the most distant point on the periphery of the interception area $A_C$. Likewise, the announcement transmission distance e may in such cases correspond to the distance from the position $POS_{AT}$ of the announcement transmitter 101 to the most distant point on the periphery of the interception area $A_E$. Of course, in the previously described cases wherein the interception transmission distance c and the announcement transmission distance e correspond to the radiuses of the transmission areas $A_C$ and $A_E$, respectively, these transmission distances c and e can also be described as corresponding to the distance from the position $POS_{AT}$ of the announcement transmitter 101 to the most distant point on the periphery of the interception area $A_C$ and $A_E$, respectively.

Preferably, the shape of each transmission area is selected such that it provides the road occupants present in the receiver comprising vehicles a warning within a preset warning time, set so that the road occupants will have time to react to the traffic event announced, thereby preventing traffic accidents. Furthermore, the transmissions of the interception transmitter 102 and the announcement transmitter do not have to be of the same shape, but different combinations with regard to the type of transmission may be applied.

The system 100 may further comprise a user interface 106 configured to generate an input signal $S_{INPUT}$ indicative of user input, in response to a user interacting with the user interface 106; and to send the input signal $S_{INPUT}$ to the data processor 104. The user input may for example relate to turning the system 100 on or off, and/or determining a message sent on the announcement transmitter 101. The data processor 104 is in these embodiments configured to receive user input parameters from the user interface 106. The user input parameters are in these embodiments preferably generated in response to user commands entered via by a user interacting with one or more input devices connected to the user interface 106. The one or more input devices may comprise a keyboard and/or computer mouse or other pointing device, touchscreen, speech recognition functionality or any other suitable input device. The input may in some embodiments be provided via a graphical user interface (GUI) presented on a display by the user interface 106.

In one or more embodiments, the data processor 104 is further configured to control the interception transmitter 102 to transmit the first radio signal $S_{IT}$ to at least one announcement receiver $\mathbf{103}_1 \ldots \mathbf{103}_n$ at the first transmission power $POWER_{IT}$. This is achieved by the data processor being configured to generate a first control signal indicative of the first transmission power $POWER_{IT}$, and to send the first control signal to the interception transmitter 102. In these embodiments, the interception transmitter 102 is in turn further configured to receive the first control signal from the data processor 104 and, in response to receiving the first control signal, transmit the first radio signal $S_{IT}$ to at least one announcement receiver $\mathbf{103}_1 \ldots \mathbf{103}_n$ at the first transmission power $POWER_{IT}$.

In one or more embodiments, the data processor 104 is further configured to control the announcement transmitter 101 to transmit the second radio signal $S_{AT}$ to at least one announcement receiver $\mathbf{103}_1 \ldots \mathbf{103}_n$ at the second transmission power $POWER_{AT}$. This is achieved by the data processor being configured to generate a second control signal indicative of the second transmission power $POWER_{AT}$ and to send the second control signal to the announcement transmitter 101. In these embodiments, the announcement transmitter 101 is in turn further configured to receive the second control signal from the data processor 104 and, in response to receiving the second control signal, transmit the second radio signal $S_{AT}$ to at least one announcement receiver $\mathbf{103}_1 \ldots \mathbf{103}_n$ at the second transmission power $POWER_{AT}$.

Figure 5:
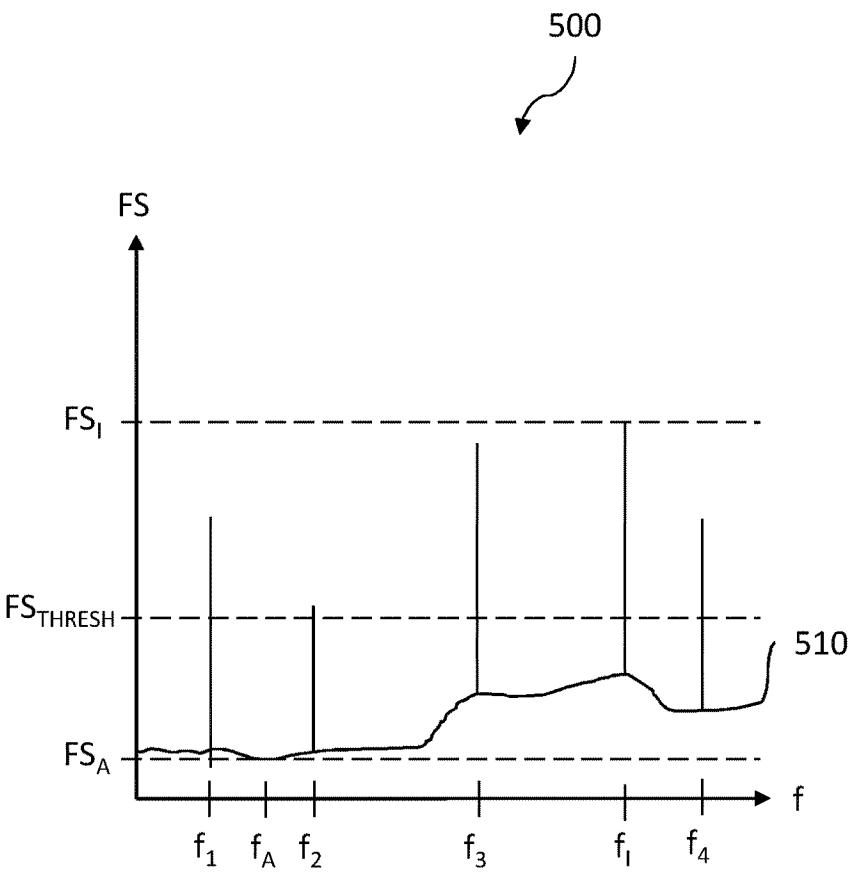
FIG. 5 is a graph illustrating an exemplary frequency spectrum and the related signal strength distribution of an input signal $S_{111}$ at the position of an announcement receiver 103.

Within the frequency spectrum of the input signal $S_{111}$ there may be more than one frequency, e.g. $f_1$, $f_2$, $f_3$, $f_4$ etc., $f_1 \ldots f_j$, or at which a radio channel or program is being broadcast at the time for transmitting the warning message or announcement. This is illustrated in the example graph 500 of FIG. 5, wherein 510 illustrates the frequency spectrum of an example input signal $S_{111}$, and each frequency with a peak amplitude or field strength value, i.e. frequencies $f_1$, $f_2$, $f_3$, $f_4$, $f_I$ exemplify frequencies on which radio programs are currently being broadcast. The data processor 104 may be configured to identify the frequencies $f_1 \ldots f_j$ on which a radio channel or program is being broadcast at the time for transmitting the warning message or announcement by comparing e.g. the signal strength, field strength and/or signal quality (for example determined using signal to noise ratio or bit error rate measurements) of each frequency in the input signal $S_{111}$ to a threshold value $FS_{THRESH}$. If the signal strength, field strength and/or signal quality of a frequency f is e.g. equal to or greater than the threshold value $FS_{THRESH}$, the data processor 104 may be configured to determine that the frequency belongs to the group of frequencies $f_1 \ldots f_j$ on which a radio channel or program is currently being broadcast. In FIG. 5, an example field strength threshold value $FS_{THRESH}$ is indicated.

Each of the at least one announcement receiver $\mathbf{103}_1 \ldots \mathbf{103}_n$ may at any given time instance be tuned to any one of the frequencies $f_1 \ldots f_j$ on which a radio channel or program is being broadcast. In order to intercept the signal received by each of the at least one announcement receiver $\mathbf{103}_1 \ldots \mathbf{103}_n$ the data processor 104 may therefore be configured to control the interception transmitter 102 to transmit the first radio signal $S_{IT}$ at each of the frequencies $f_1 \ldots f_j$ on which a radio channel or program is being broadcast at the time for transmitting the warning message or announcement. Thereby, it is ensured that a warning message or announcement transmitted by the announcement transmitter 101 can be heard at each announcement receiver $\mathbf{103}_i$. This in turn enables a driver of a vehicle comprising at least one announcement receiver $\mathbf{103}_i$ to have the best possible prospect of hearing such a warning message or announcement clearly.

In some embodiments, the data processor 104 is configured to control the interception transmitter 102 to transmit the first radio signal $S_{IT}$ to each of the frequencies $f_1 \ldots f_j$ on which a radio channel or program is being broadcast in sequence, which is illustrated by the looping schedule shown in FIG. 6. This is advantageously a low complexity solution that guarantees that all of the of the frequencies $f_1 \ldots f_j$, on which a radio channel or program is being broadcast are reached by the first radio signal $S_{IT}$. For the interception transmitter 102, such a sequential transmission, or looping transmission, will take a certain time to perform. This time is, hereinafter referred to as a looping time $T_L$. As shown in FIG. 6, the looping time $T_L$ is calculated as the time it takes for the interception transmitter 102 to transmit the first radio signal $S_{IT}$, herein referred to as the time x, times the number of frequencies to which it is assigned to broadcast. In the case of a single interception transmitter, the number of frequencies to which it is assigned to broadcast corresponds to all the frequencies $f_1 \ldots f_j$ on which a radio channel or program is currently being broadcast. The time x can be preset, or accessible to the system 100, and depends on the respective interception transmitter 102 being used. In other words:

$$T_L = x^*(\text{number of frequencies to transmit to})$$

As an illustrative example, in FIG. 6 $T_L$=4x. As further non-limiting examples, the time x may be in the interval of 1 to 10 s, preferably under 5 s, more preferably about 1 to 3 seconds. The time x depends on the announcement receiver and it may be preset or estimated during operation.

In case of using a looping schedule, the time $T_{TOTAL}$ corresponds to the maximum time that passes from the time that an announcement receiver first receives the announcement signal to the time when the vehicle comprising the announcement receiver arrives at the location of the traffic event to which the announcement relates. In this context, the vehicle comprising the announcement receiver arriving at the location of the traffic event to which the announcement relates also includes the case where an approaching emergency vehicle arrives at the location of the vehicle comprising the announcement receiver. In other words, the time $T_{TOTAL}$ corresponds to the maximum time that passes from the time instance that the announcement receiver $\mathbf{103}_i$ receives the second radio signal $S_{AT}$ until the time instance that the position of the announcement receiver $\mathbf{103}_i$ corresponds to the position $POS_{AT}$ of the announcement transmitter 101.

The time $T_{TOTAL}$ is calculated as the sum of the times $T_W$ and $T_L$:

$$T_{TOTAL} = T_W + T_L.$$

Figure 7:
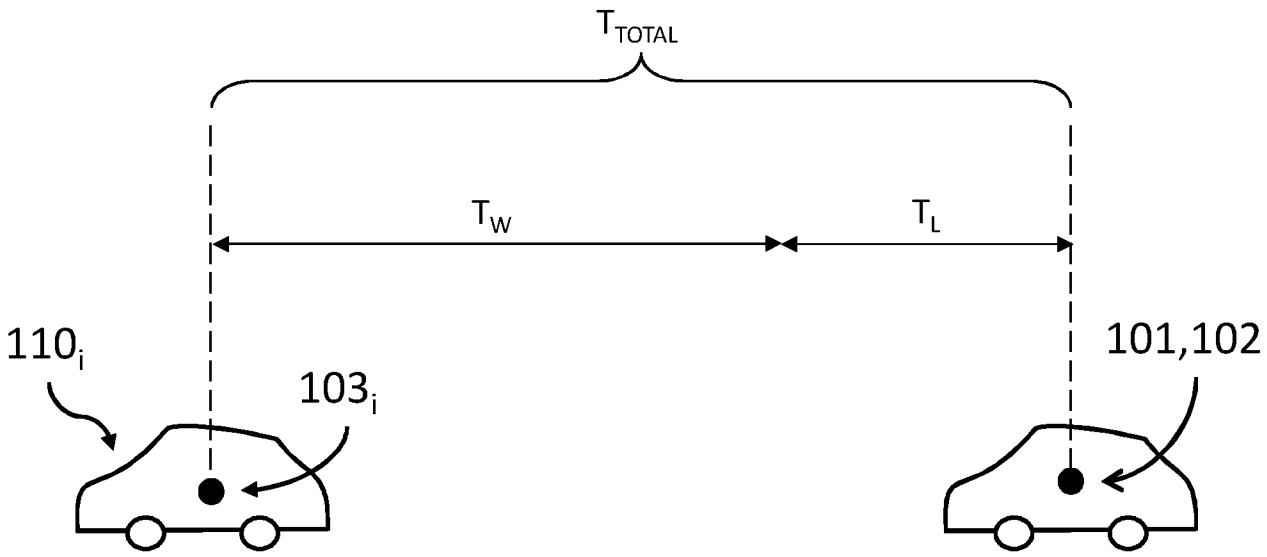
FIG. 7 shows an example of a distance $T_{TOTAL}$ according to one or more embodiments.

An illustrational example of $T_{TOTAL}$ as the sum of $T_W$ and $T_L$, wherein the announcement transmitter 101 and the interception transmitter 102 are in this non-limiting example comprised in an emergency vehicle, is illustrated in FIG. 7.

To guarantee the preset warning time $T_W$ during operation, i.e. to guarantee that each of the at least one announcement receiver $\mathbf{103}_1 \ldots \mathbf{103}_n$ receives the warning message or announcement at least the preset minimum time before arriving at an event of importance, e.g. arriving at the location of a traffic event, or having an approaching emergency vehicle arriving at the location of the vehicle with the announcement receiver $\mathbf{103}_i$, the interception transmission distance c is calculated using the maximum time $T_{TOTAL}$ and a relative velocity $V_{REL}$ according to the following relation:

$$c = T_{TOTAL} * V_{REL}$$

If there are many already available channels $f_1 \ldots f_i$ the time $T_L$ will become large resulting in a large $T_A$ and thus also an unnecessary large transmission distance c. An unnecessary large transmission distance c may result in that receivers 103 that not are in the close area of the event of importance, and are therefore not intended to receive the announcement, may still receive the warning message or announcement. Furthermore, a large transmission area also means that a high output power is required from the interception transmitter 102. This puts requirements on the design of the interception transmitter 102 that may be difficult to fulfill while still fulfilling other practical limitations such as keeping within a reasonable level of power consumption, a practical size of unit etc.

To solve this issue, more than one interception transmitter 102 may advantageously be used, wherein each of the more than one interception transmitters 102 is configured to transmit the first radio signal $S_{IT}$ to a respective group of one or more of the frequencies. $f_1 \ldots f_j$ on which a radio channel or program is being broadcast, and wherein the data processor 104 may be configured to control each of the interception transmitters 102 to transmit the first radio signal $S_{IT}$ in this manner. In these embodiments, the data processor 104 is configured to divide the frequencies $f_1 \ldots f_j$ on which a radio channel or program is being broadcast into groups, wherein the number of groups corresponds to the number of interception transmitters 102, and wherein each of the frequencies $f_1 \ldots f_j$ on which a radio channel or program is being broadcast is included in one of the groups of frequencies. The data processor 104 is further configured to control each of the interception transmitters 102 to transmit the first radio signal $S_{IT}$ at the frequencies comprised in a respective group of frequencies in sequence, according to a looping schedule. Thereby, the interception transmitters are controlled by the data processor 104 to split the frequencies on which a radio channel or program is being broadcast between them and perform parallel sequences, or loops, of transmission, wherein each of the parallel sequences is shorter than the one performed by a single interception transmitter 102 covering all frequencies in this manner would be. In this way, the time $T_L$ for the respective interception transmitter 102 can be reduced, thus reducing the interception distance c and the interception area $A_C$. Consequently, the risk that vehicles that are not intended for receiving a warning message or announcement still receives it is reduced.

It is often important to reduce the combined/total output power of the more than one interception transmitters 102. Therefore using any of the method embodiments described herein utilizing at least two interception transmitters 102, the data processor 104 may be configured to optimize the grouping of frequencies and assignment of each group to a respective one of the at least two interception transmitters 120 such that the total output power needed to cover all frequencies $f_1 \ldots f_j$ on which a radio channel or program is being broadcast is minimized. The data processor 104 is in these embodiments configured to optimize the grouping of frequencies and assignment of frequency groups to the interception transmitters 120 based on the signal strength, or field strength, of the respective frequencies $f_1 \ldots f_j$ on which a radio channel or program is being broadcast, the warning time $T_W$ and the time x of the respective interception transmitter 102. For example, if a channel or program is broadcast on a frequency (i.e. one of the frequencies $f_1 \ldots f_j$) having a very high, or strong, field strength, the data processor 104 may be configured to include said frequency in a group associated with an interception transmitter 102 having a short time $T_L$. Thereby, the time $T_L$ for that interception transmitter 120 and consequently also the overall output power, or transmission power, needed for that interception transmitter 120 is minimized. On the other hand, if a channel or program is broadcast on a frequency (i.e. one of the frequencies $f_1 \ldots f_j$) having a week, or low, field strength, the data processor 104 may be configured to include said frequency in a group associated with an interception transmitter 102 having a longer time $T_L$, as the overall output or transmission power needed, will still not become very large for that interception transmitter 120. In some cases, it may for example be advantageous to use one interception transmitter 102 to transmit onto only one or a low number of frequencies and the one or more other interception transmitters 102 to transmit onto the remaining frequencies, if this minimizes the overall output or transmission power needed. In other cases, a more even division of the number of frequencies between the at least two interception transmitter 102 may be more advantageous, if this minimizes the overall output or transmission power needed. The data processor 104 may in this way be configured to optimize the grouping of the frequencies $f_1 \ldots f_j$ such that overall output or transmission power needed to transmit the interception signal $S_{IT}$ onto all frequencies $f_1 \ldots f_j$ using the at least two interception transmitters 102 is minimized.

Of course, it is possible to use one interception transmitter and/or one announcement transmitter for each of the frequencies $f_1 \ldots f_j$, if this should for some reason be the most advantageous solution under particular circumstances.

In one or more embodiments, the system 100 is configured to, before controlling the one or more announcement transmitter 101 to transmit the announcement signal $S_{AT}$, trigger the respective at least one announcement receiver $\mathbf{103}_1 \ldots \mathbf{103}_n$ to tune into the second frequency $f_A$. This may e.g. be done by the interception signal $S_{IT}$ comprising information triggering the respective at least one announcement receiver $\mathbf{103}_1 \ldots \mathbf{103}_n$ to tune into the second frequency $f_A$. In some embodiments, the data processor 104 may be configured to add information to the interception signal $S_{IT}$ that will trigger the respective at least one announcement receiver $\mathbf{103}_1 \ldots \mathbf{103}_n$ to tune into the second frequency $f_A$ before the interception signal $S_{IT}$ is sent. There, the system is enabled to reach all the respective at least one announcement receiver $\mathbf{103}_1 \ldots \mathbf{103}_n$ with the announcement by broadcasting on a single frequency, i.e. the second frequency $f_A$. This is of course a very inexpensive solution with regard to the number of announcement receivers 101 needed as well as output power and bandwidth requirements. In these embodiments, the at least one announcement receiver 101 is configured to, in response to receiving the control signal, transmitting the announcement signal $S_{AT}$ to at least one announcement receiver $\mathbf{103}_1 \ldots \mathbf{103}_n$ at the second transmission power $POWER_{AT}$ at the second frequency $f_A$.

The units of the system 100 may be configured to use any suitable wired and/or wireless communication technologies known in the art for communicating with each other.

In one or more embodiment, the data processor 104 is further configured to perform any of the method steps or functions described in the method embodiments herein.

METHOD EMBODIMENTS

Figure 3:
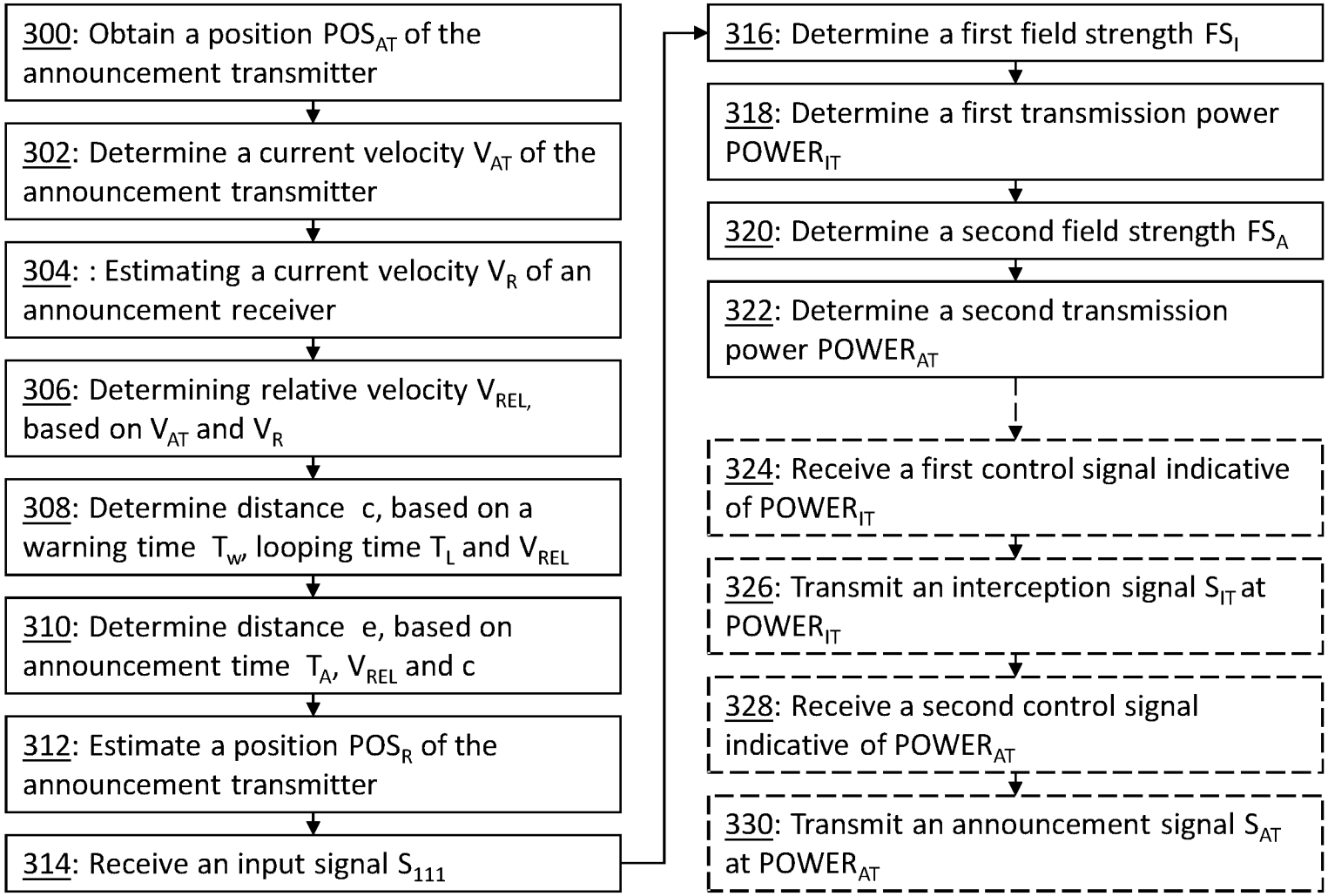
FIG. 3 is a flow chart of a method for optimizing output transmission power according to one or more embodiments.

FIG. 3 shows a method according to one or more embodiments for determining output transmission power for radio signal transmission from an interception transmitter 102 and an announcement transmitter 101 to at least one announcement receiver $\mathbf{103}_1 \ldots \mathbf{103}_n$, wherein each announcement receiver 103 is comprised in a respective motor vehicle 110, the method comprising:

In step 300: obtaining, in a data processor 104 communicatively coupled to the announcement transmitter 101 and the interception transmitter 102, a position $POS_{AT}$ of the announcement transmitter 101.

In some embodiments, the position $POS_{AT}$ of the announcement transmitter 101 is obtained from a position determination unit 108.

In step 302: determining, by the data processor 104, a current velocity $V_{AT}$ of the announcement transmitter 101.

In one or more embodiments, the current velocity $V_{AT}$ of the announcement transmitter 101 may be determined based on information from the position determination unit 108. The position determination may in this case for instance be a global positioning system (GPS).

Alternatively, or in combination with the above, if the announcement transmitter 101 is located in or on a vehicle, the current velocity $V_{AT}$ of the announcement transmitter 101 may be determined based on information from an On-Board-Diagnostics (OBD) port of the vehicle, and/or from a sensor on the Controller Area Network (CAN bus) system of the vehicle.

In some embodiments, the announcement transmitter 101 may located in or on, or integrated in, an object such as a road signage or the like, whereby the current velocity $V_{AT}$ of the announcement transmitter 101 will be determined to be zero. This velocity may be determined during operation, or may be predetermined.

In one or more embodiments the method further comprises performing, for each announcement receiver $\mathbf{103}_i$ of the at least one announcement receiver $\mathbf{103}_1 \ldots \mathbf{103}_n$, steps 304 to 312:

In step 304: estimating, by the data processor 104, a current velocity $V_R$ of the motor vehicle $\mathbf{110}_i$ comprising the announcement receiver $\mathbf{103}_i$.

In one or more embodiment, the current velocity $V_R$ of the motor vehicle $\mathbf{110}_i$ comprising the announcement receiver $\mathbf{103}_i$ may be estimated based at least on the current velocity $V_{AT}$ of the announcement transmitter 101. In some non-limiting embodiments, the current velocity $V_R$ of the motor vehicle $\mathbf{110}_i$ comprising the announcement receiver $\mathbf{103}_i$ may be estimated to be the same as the known current velocity $V_{AT}$.

In other embodiments, step 304 may comprise obtaining speed limit data SLD indicative of the speed limit associated with the position $POS_{AT}$ of the announcement transmitter 101; and estimating the current velocity $V_R$ of the motor vehicle 110 comprising the announcement receiver $\mathbf{103}_i$ based at least on the obtained speed limit data, SLD. In some embodiments, the SLD may be obtained from a road data database 109. In other embodiments, the SLD may be obtained by capturing, by an imaging device, an image of the surroundings of the announcement transmitter 101; analyzing the captured image to determine if there is a sign showing a speed limit depicted in the image; and if there is a sign showing a speed limit depicted in the image, determining the speed limit shown and generate the SLD based on the determined speed limit.

In step 306: determining, by the data processor 104, a relative velocity $V_{REL}$ between the announcement transmitter 101 and the motor vehicle $\mathbf{110}_i$ comprising the announcement receiver $\mathbf{103}_i$, based on the current velocities $V_{AT}$ and $V_R$.

In some embodiments, the relative velocity may be determined according to the "worst case scenario", i.e. that the announcement transmitter 101 and the motor vehicle $\mathbf{110}_i$ comprising the announcement receiver $\mathbf{103}_i$ are travelling in opposite directions, away from each other. This approach of course provides the largest safety margin with regard to the vehicle comprising an announcement receiver not having time to, from receiving the interception signal, or first radio signal, travel such a distance that it leaves the transmission area $A_E$, i.e. the area in which the announcement signal, or second radio signal, is transmitted, before the entire announcement has been received.

In one or more embodiments, the relative velocity may be determined in any other suitable manner, based on the current velocities $V_{AT}$ and $V_R$, for example according to the assumption that the announcement transmitter 101 and the motor vehicle $\mathbf{110}_i$ comprising the announcement receiver $\mathbf{103}_i$ are travelling in opposite directions, towards each other, or that the announcement transmitter 101 and the motor vehicle $\mathbf{110}_i$ comprising the announcement receiver $\mathbf{103}_i$ are travelling in the same direction.

In some embodiments the announcement transmitter 101 and/or the interception transmitter 102 may be incorporated in a stationary motor vehicle, e.g. a stationary emergency vehicle, a road signage, another stationary installation in the vicinity of a road, etc., whereby the velocity $V_{AT}$ is consequently zero. In these embodiments, the relative velocity $V_{REL}$ may of course be determined solely based on the current velocity $V_R$.

In step 308: determining, by the data processor 104, an interception transmission distance c, based on a preset warning time $T_W$, indicative of the minimum time from the time instance that the announcement receiver $\mathbf{103}_i$ receives the second radio signal $S_{AT}$ until the time instance that the position of the announcement receiver $\mathbf{103}_i$ corresponds to the position $POS_{AT}$ of the announcement transmitter 101, and the relative velocity $V_{REL}$.

In step 310: determining, by the data processor 104, an announcement transmission distance e, based on a preset announcement time $T_A$ indicative of the length of the announcement to be transmitted, the relative velocity $V_{REL}$ and the interception transmission distance c.

The announcement transmission distance e is according to one or more embodiment greater than the interception transmission distance c. This is illustrated in the example embodiments shown in FIGS. 2A to 2C. The examples shown in the figures are illustrational only, and not to scale.

In step 312: estimate a position $POS_R$ of the motor vehicle $\mathbf{110}_1 \ldots \mathbf{110}_n$ comprising the announcement receiver $\mathbf{103}_1 \ldots \mathbf{103}_n$;

In some embodiments, the position $POS_R$ of the motor vehicle $\mathbf{110}_1 \ldots \mathbf{110}_n$ comprising the announcement receiver $\mathbf{103}_1 \ldots \mathbf{103}_n$ may be estimated to be the same as a position $POS_{AT}$ of the announcement transmitter 101. This is very computationally inexpensive.

Figure 2C:
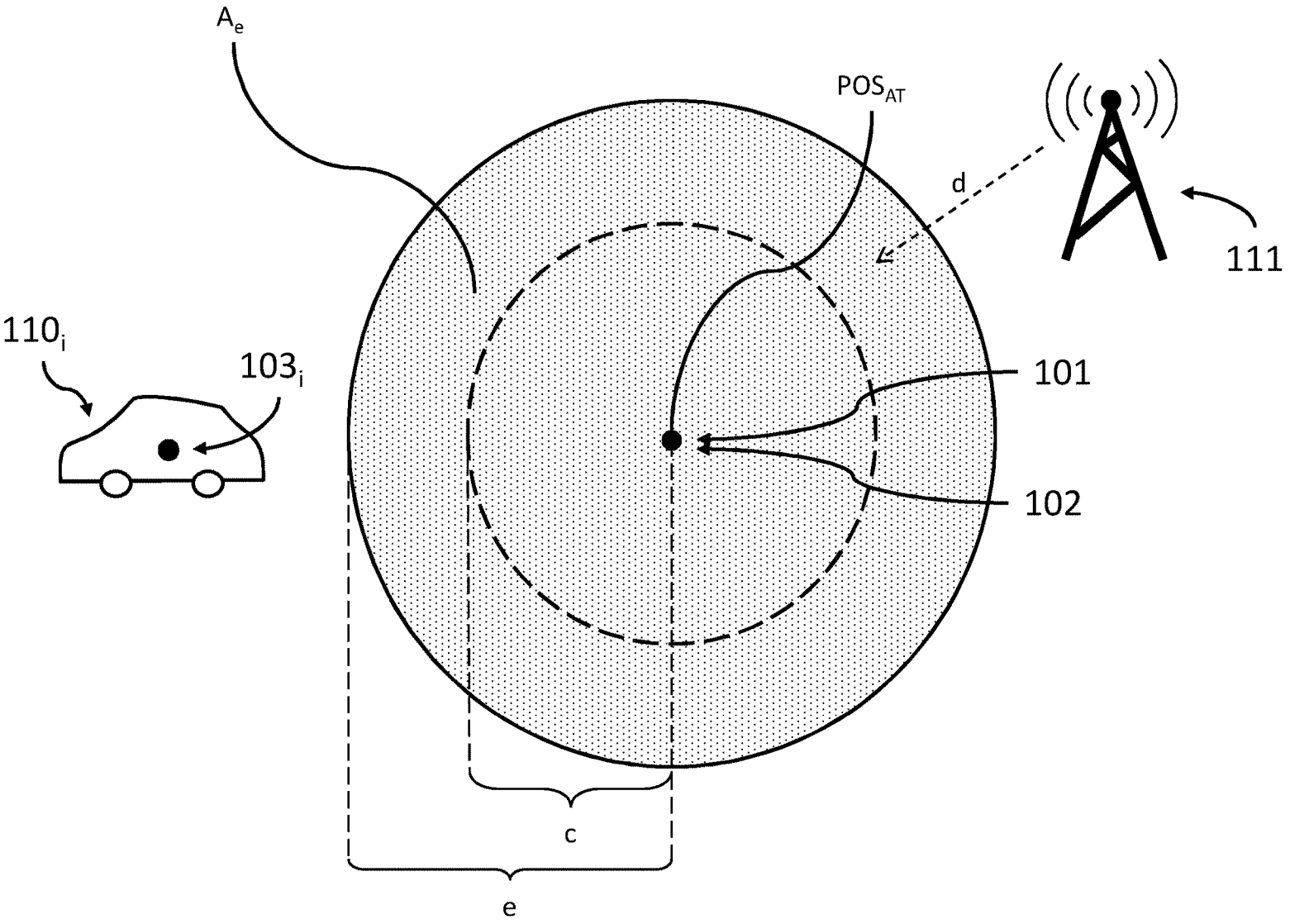

The reason that this is a suitable approximation in the current context is that the distance between the motor vehicle $\mathbf{110}_1 \ldots \mathbf{110}_n$, comprising the announcement receiver $\mathbf{103}_1 \ldots \mathbf{103}_n$, and the announcement transmitter 101, illustrated as the distance e in FIGS. 2A to 2C, is typically very small, in some cases even negligible, compared to the distance between the motor vehicle $\mathbf{110}_1 \ldots \mathbf{110}_n$ and an input signal source 111 from which an input signal $S_{111}$ is transmitted, which is illustrated as distances d+e in FIG. 2A. For the determination of field strength values at position $POS_R$, according to any embodiment presented herein, the approximated position of $POS_R$ being set to be equal to $POS_{AT}$ will therefore provide a sufficiently accurate result. It is to be noted that FIGS. 2A to 2C are not to scale with regard to the relative distance between $POS_R$ and $POS_{AT}$, on one hand, and between $POS_R$ and the input signal source 111, on the other hand. The figures are for illustrational purposes only.

In some embodiments, if the direction of travel of the announcement receiver 101 is known along with the distances c and e, $POS_R$ can be more accurately estimated, but at a higher computational cost.

A combination of the two above approaches is also feasible, depending on the circumstances.

The method illustrated in FIG. 3 may further comprise:

In step 314: receiving from an input signal receiver 107, in the data processor 104, an input signal $S_{111}$.

There may be more than one input signal receiver 107 in the system and the data processor 104 may in this case receive input signals $S_{111}$ from one or more of these input signal receivers 107.

In step 316: determining, by the data processor 104, a first field strength $FS_I$ of the input signal $S_{111}$, at a first frequency $f_I$, at the position $POS_R$.

The first frequency $f_I$ may in some embodiments be selected as the frequency having the highest amplitude or field strength value in the frequency spectrum of the signal $S_{111}$. This example is illustrated in the graph 500 of FIG. 5, wherein 510 illustrates the frequency spectrum of the signal $S_{111}$, and each frequency with a peak amplitude or field strength value, i.e. frequencies $f_1$, $f_2$, $f_3$, $f_I$, $f_4$, exemplify frequencies on which radio programs are currently being broadcast. Of course, any other frequency may be selected, based on other criteria, depending on circumstances. The selection of the first frequency $f_I$ is in all embodiments made such that a frequency at which a radio program to be suppressed or overridden is currently being broadcast. By selecting the frequency having the highest, or at least a comparably high, amplitude or field strength value as first frequency $f_I$, it is ensured that the first transmission power $POWER_{IT}$, determined in step 318, will be high enough to enable suppressing or overriding the signal $S_{111}$. This means that the first transmission power $POWER_{IT}$, determined in step 318, will be high enough to enable suppressing or overriding a channel or program on any of the frequencies $f_1 \ldots f_j$, which is currently being broadcast.

In some embodiments, the first field strength $FS_I$ of the input signal $S_{111}$, at the first frequency $f_I$, at the position $POS_R$, may be determined by looking it up in a frequency data database which comprises field strength values, for the frequency spectrum of one or more radio signal, associated with positions or location information. The look-up determination using the frequency data database may be done by mapping the input signal $S_{111}$, at the first frequency $f_I$, at the position $POS_R$, to an associated field strength value.

The determination according to these embodiments may further comprise checking that the associated field strength value was determined and/or entered into the frequency data database recently. This may for example be done by comparing a preset time threshold value to the amount of time that has passed since the associated field strength value was determined and/or entered into the frequency data database to the time instance when the look up is performed, and setting the first field strength $FS_I$ to the associated field strength value if the amount of time that has passed is less than, or equal to, the preset time threshold value.

In one or more embodiments, for example if the amount of time that has passed is greater than the preset or predetermined time threshold value, or if it is for any other reason found to be a more suitable method, the first field strength $FS_I$ may instead be calculated or otherwise determined, by the data processor 104, based on information received from the input signal receiver 107 regarding the input signal $S_{111}$, at the first frequency $f_I$, at the position $POS_R$. In some embodiments, the method may comprise repeatedly determining the field strength value for one or more frequencies of the input signal $S_{111}$, at the current position $POS_R$, at a certain time interval or after a certain distance travelled. The calculated first field strength $FS_I$ value, or the calculated field strength values for one or more frequencies, may in these embodiments be entered into the frequency data database for later use. The generation and updating of the frequency data database is further described in connection with FIG. 4.

Looking up the first field strength $FS_I$ value in the frequency data database provides the advantage that less computational power, and less time, is required. On the other hand, by calculating the first field strength $FS_I$ value at the first frequency $f_I$, at the position $POS_R$, at each relevant moment, a highly accurate result is achieved.

Any of the described approaches for determining the first field strength, or a combination, may be selected depending on the circumstances.

The frequency data database could be implemented as a part of the system 100, or be external to, and accessible by, the system 100.

Alternatively, or in combination with any of the above embodiments, the first field strength $FS_I$ may be estimated using any model for signal attenuation over a transmission distance or area known in the art, for example, but not limited to: free space path loss, Friis transmission formula or ITU-R P.1546.

In one or more embodiments, the method may comprise identifying, by the data processor 104, the frequencies $f_1 \ldots f_j$ on which a radio channel or program is being broadcast at the time for transmitting the warning message or announcement by, for each frequency in the input signal $S_{111}$: comparing, by the data processor 104, a value V corresponding to the signal strength, the field strength or the signal quality of the frequency to a threshold value $FS_{THRESH}$; and determining, by the data process 104, that the frequency belongs to the group of frequencies $f_1 \ldots f_j$ on which a radio channel or program is currently being broadcast if the value V is equal to or higher than the threshold value $FS_{THRESH}$.

In step 318: determining, by the data processor 104, a first transmission power $POWER_{IT}$ of the first radio signal $S_{IT}$ needed to suppress the input signal $S_{111}$ at the interception transmission distance c.

In one or more embodiments, the first transmission power $POWER_{IT}$ may be determined based on one or more of the following parameters: the interception transmission distance c; the attenuation of a transmitted radio signal over the interception transmission distance c; the first field strength $FS_I$ of the input signal $S_{111}$; and a predetermined suppression level.

In some embodiments, the first transmission power $POWER_{IT}$ may be determined based on all of the said parameters.

The suppression level may be predetermined as how much stronger that the first radio signal $S_{IT}$ needs to be compared to the input signal $S_{111}$ to suppress the input signal $S_{111}$. The suppression level may for example be determined based on experiment. In a non-limiting example, the inventors have found that a suitable lowest suppression level, i.e. how many dB stronger that the field strength of the first radio signal $S_{IT}$ at least needs to be compared to the field strength of the input signal $S_{111}$ to suppress the input signal $S_{111}$, is 4 dB, or a level close to 4 dB.

The first transmission power $POWER_{IT}$ may be represented as a power value, for example expressed in dB.

In step 320: determining, by the data processor 104, a second field strength $FS_A$ of at least one of: atmospheric noise received from the input signal receiver 107; and the input signal $S_{111}$, at a second frequency $f_A$, at the position $POS_R$.

In one or more embodiments, the second field strength $FS_A$ relating to the input signal $S_{111}$, at a second frequency $f_A$, at the position $POS_R$ may be determined in any of the manners described for determining the first field strength $FS_I$ in step 314.

Determination of the atmospheric noise may be performed in any manner known in the art.

The second frequency $f_A$ may be selected automatically or by user input, for instance by a user interacting with the user interface 106.

The second frequency $f_A$ may in some embodiments, as illustrated in FIG. 5, be selected as the frequency with the lowest floor noise amplitude and/or the lowest signal amplitude within the frequency spectrum 510 of the input signal $S_{111}$. This can be seen as selecting a "free" spot in the frequency spectrum for transmission of the second radio signal $S_{AT}$, which comprises the announcement intended to reach one or more receivers $\mathbf{130}_1 \ldots \mathbf{130}_n$, and be heard by the recipients in the one or more vehicles $\mathbf{110}_1 \ldots \mathbf{110}_n$. Thereby, use of the lowest possible output transmission power is enabled, with maintained signal quality at the receiver end. Other selection criteria for selecting the second frequency $f_A$ are of course possible. It would require at least slightly higher transmission output power, but may still be found preferable depending on circumstances.

In step 322: determining, by the data processor 104, a second transmission power $POWER_{AT}$ of second radio signal $S_{AT}$.

In one or more embodiments, the second transmission power $POWER_{AT}$ may be determined based on one or more of the following parameters: the announcement transmission distance e; the attenuation of a transmitted radio signal over the announcement transmission distance e; the second field strength $F_{SA}$; and a predetermined signal quality threshold value Q. In some embodiments, the second transmission power $POWER_{AT}$ may be determined based on all of the said parameters.

The attenuation of a transmitted radio signal over the announcement transmission distance e may for example be determined or estimated using any formula describing power loss of a radio wave or signal across space or distance. Some non-limiting examples of formulas that may be used are the free-space path loss (FSPL) formula, Friis transmission formula or ITU-R P.1546

The signal quality threshold value Q may represent the lowest acceptable signal quality of the announcement signal $S_{AT}$ received at an announcement receiver $\mathbf{103}_1 \ldots \mathbf{103}_n$. The signal quality threshold value Q may be selected such that it guarantees clear reception at each announcement receiver $\mathbf{103}_1 \ldots \mathbf{103}_n$. The signal quality threshold value Q may be defined using any appropriate signal quality measure known in the art, and may be preset, for example by a user of the system 100.

The second transmission power $POWER_{AT}$ may be represented as a power value, for example expressed in dB.

In one or more non-limiting embodiments, the method described in connection with FIG. 3 may further comprise the following optional steps:

In an optional step 324: receiving, in the interception transmitter 102, a first control signal indicative of the first transmission power $POWER_{IT}$ from the data processor 104.

In an optional step 326: in response to receiving the first control signal, transmit an interception signal $S_{IT}$ to at least one announcement receiver $\mathbf{103}_1 \ldots \mathbf{103}_n$ at the first transmission power $POWER_{IT}$.

Thereby, the interception signal is sent to the at least one announcement receiver $\mathbf{103}_1 \ldots \mathbf{103}_n$ at a transmission power sufficient to suppress the signal d at the distance c.

Step 326 may comprise controlling, by the data processor 104, the at least one interception transmitter 102 to transmit the first radio signal $S_{IT}$ at each of the frequencies $f_1 \ldots f_j$ on which a radio channel or program is being broadcast at the time for transmitting the warning message or announcement, preferably in sequence.

In embodiments wherein more than one interception transmitter 102 is used, the method may comprise transmitting, by each of the more than one interception transmitter 102 the first radio signal $S_{IT}$ to a respective group of one or more of the frequencies $f_1 \ldots f_j$ on which a radio channel or program is being broadcast. This may in some embodiments comprise controlling, by the data processor 104, each of the more than one interception transmitter 102 to transmit the first radio signal $S_{IT}$ to a respective group of one or more of the frequencies $f_1 \ldots f_j$ on which a radio channel or program is being broadcast. In these embodiments, the method may further comprise dividing, by the data processor 104, the frequencies $f_1 \ldots f_j$ on which a radio channel or program is being broadcast into groups, wherein the number of groups corresponds to the number of interception transmitters 102, and wherein each of the frequencies. $f_1 \ldots f_j$ on which a radio channel or program is being broadcast is included in one of the groups of frequencies. In these embodiments, the method further comprises controlling, by data processor 104, each of the interception transmitters 102 to transmit the first radio signal $S_{IT}$ at the frequencies comprised in a respective group of frequencies in sequence, according to a looping schedule.

In some embodiments, step 326 may comprise optimizing, by the data processor 104, the grouping of frequencies and assignment of each group to a respective one of the at least two interception transmitters 102 such that the total output power needed to cover all frequencies $f_1 \ldots f_j$ on which a radio channel or program is being broadcast is minimized. In some of these embodiments, the optimizing of the grouping of frequencies and assignment of frequency groups to the interception transmitters to minimize the overall output or transmission power needed to transmit the interception signal $S_{IT}$ onto all frequencies $f_1 \ldots f_j$ may be based on the signal strength or field strength of the respective frequencies $f_1 \ldots f_j$ on which a radio channel or program is being broadcast, the warning time $T_W$, and the time x of the respective interception transmitter 102.

As a further option, possibly in combination with the optional features of steps 324 and 326, the method described in connection with FIG. 3 may further comprise:

In an optional step 328: receiving, in the announcement transmitter 101, a second control signal indicative of the second transmission power $POWER_{AT}$ from the data processor 104.

In an optional step 330: in response to receiving the control signal, transmit an announcement signal $S_{AT}$ to at least one announcement receiver $\mathbf{103}_1 \ldots \mathbf{103}_n$ at the second transmission power $POWER_{AT}$.

Thereby, the announcement signal $S_{AT}$ is sent to the at least one announcement receiver $\mathbf{103}_1 \ldots \mathbf{103}_n$ at a transmission power that is sufficient to provide good quality of sound at the transmission distance c. In other words, the announcement will be enabled to be heard by all the intended recipients, i.e. the drivers and passengers of the at least one motor vehicles in which the respective at least one announcement receiver $\mathbf{103}_1 \ldots \mathbf{103}_n$ is comprised.

In one or more embodiments, the method comprises, before transmitting the announcement signal $S_{AT}$, triggering, by the data processor 104, the respective at least one announcement receiver $\mathbf{103}_1 \ldots \mathbf{103}_n$ to tune into the second frequency $f_A$. This may e.g. be done by the interception signal $S_{IT}$ comprising information triggering the respective at least one announcement receiver $\mathbf{103}_1 \ldots \mathbf{103}_n$ to tune into the second frequency $f_A$. There, it is enabled to reach all the respective at least one announcement receiver $\mathbf{103}_1 \ldots \mathbf{103}_n$ with the announcement by broadcasting on a single frequency, i.e. the second frequency $f_A$, which is very inexpensive with regard to output power and bandwidth requirements. In these embodiments, optional step 330 comprises, in response to receiving the control signal, transmitting the announcement signal $S_{AT}$ to at least one announcement receiver $\mathbf{103}_1 \ldots \mathbf{103}_n$ at the second transmission power $POWER_{AT}$ at the second frequency $f_A$.

Figure 4:
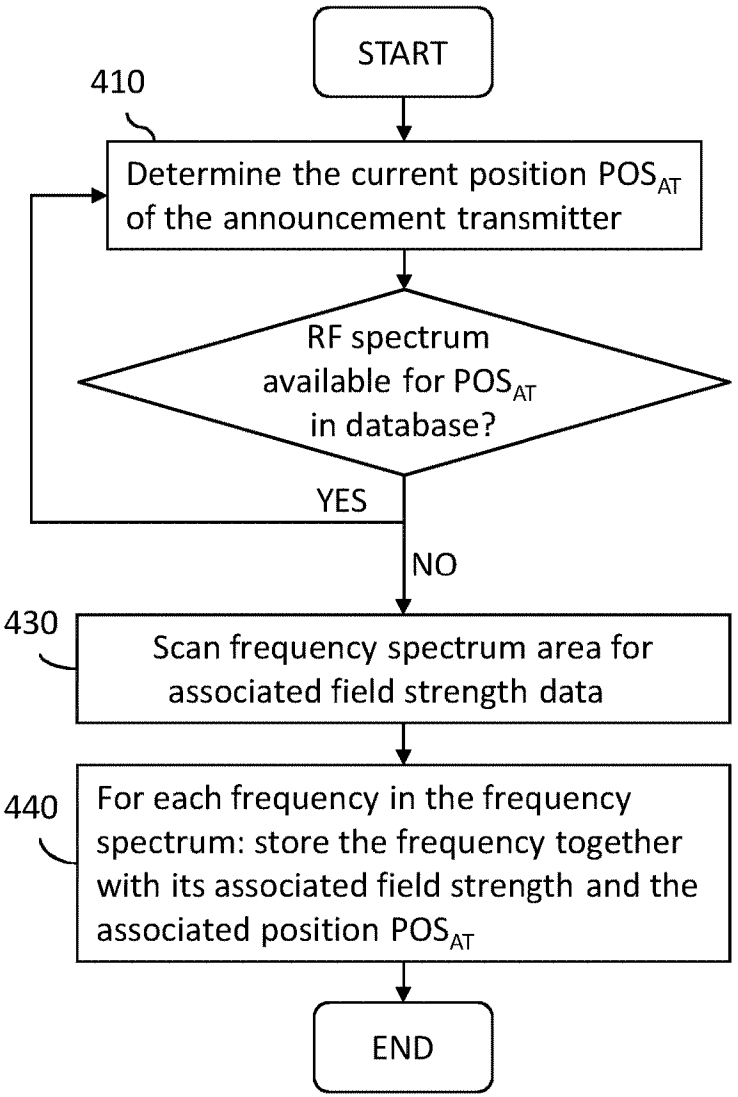
FIG. 4 is a flow chart of a method for generating a frequency spectrum data database according to one or more embodiments.

FIG. 4 shows a one or more method embodiments for generating a frequency spectrum data database, for use in any of the method embodiments described in connection with FIG. 3. The method shown in FIG. 4 comprises:

In step 410: determining the current position $POS_{AT}$ of the announcement transmitter 101.

In step 420: determining if there is a radio frequency spectrum available in a frequency data database for the current position $POS_{AT}$.

If no frequency data database has been previously generated or stored, step 420 may comprise initiating a frequency data database and continuing to step 430.

If a frequency data database exists and there is a radio frequency spectrum available for the current position $POS_{AT}$ in the frequency data database, the method returns to step 410.

If a frequency data database exists and there is no radio frequency spectrum available for the current position $POS_{AT}$ in the frequency data database, the method continues to step 430.

In step 430: scanning a frequency spectrum area available at the position $POS_{AT}$ for field strength data associated with the frequency spectrum area, using the input signal receiver 107.

In step 440: For each frequency in the frequency spectrum or frequency spectrum area: store the frequency together with its associated field strength value and the associated current position $POS_{AT}$.

The frequency spectrum data database may after generation or updating performed according to one or more embodiment described herein be used for determining the first and/or second field strengths $FS_P$, $FS_A$ in an advantageously non-computationally expensive manner.

In some embodiments, the input signal receiver 107 is configured to, and the method of FIG. 4 comprises, continuously determining the current position $POS_{AT}$, searching the available frequency spectrum area for the current position $POS_{AT}$ and storing the field strength of at least all active frequencies, associated with the current position $POS_{AT}$, in the frequency data database.

FURTHER EMBODIMENTS

All of the process steps, as well as any sub-sequence of steps, described with reference to FIG. 3 or 4 above may be controlled by means of a programmed data processor. Moreover, although the embodiments of the invention described above with reference to the drawings comprise a data processor and processes performed in at least one processor, the invention thus also extends to computer programs, particularly computer programs on or in a carrier, adapted for putting the invention into practice. The program may be in the form of source code, object code, a code intermediate source and object code such as in partially compiled form, or in any other form suitable for use in the implementation of the process according to the invention. The program may either be a part of an operating system, or be a separate application. The carrier may be any entity or device capable of carrying the program. For example, the carrier may comprise a storage medium, such as a Flash memory, a ROM (Read Only Memory), for example a DVD (Digital Video/Versatile Disk), a CD (Compact Disc) or a semiconductor ROM, an EPROM (Erasable Programmable Read- Only Memory), an EEPROM (Electrically Erasable Programmable Read-only Memory), or a magnetic recording medium, for example a floppy disc or hard disc. Further, the carrier may be a transmissible carrier such as an electrical or optical signal which may be conveyed via electrical or optical cable or by radio or by other means. When the program is embodied in a signal which may be conveyed directly by a cable or other device or means, the carrier may be constituted by such cable or device or means. Alternatively, the carrier may be an integrated circuit in which the program is embedded, the integrated circuit being adapted for performing, or for use in the performance of, the relevant processes.

In one or more embodiments, there may be provided a computer program loadable into a memory communicatively connected or coupled to at least one data processor, e.g. the data processor 104, comprising software for executing a method according any of the embodiments herein when the program is run on the at least one data processor 104.

In one or more further embodiment, there may be provided a processor-readable medium, having a program recorded thereon, where the program is to make at least one data processor, e.g. the data processor 104, execute a method according to of any of the embodiments herein when the program is loaded into the at least one data processor.

The invention is not restricted to the described embodiments in the figures, but may be varied freely within the scope of the claims.

The invention claimed is:

1. A system for determining output transmission power for radio signal transmission, the system comprising:

a data processor communicatively coupled to:

an interception transmitter configured to transmit a first radio signal across an interception area;

an announcement transmitter configured to transmit a second radio signal across an announcement area;

an input signal receiver that is configured to relay to the data processor an input signal to be suppressed; and at least one announcement receiver, wherein each of the at least one announcement receiver is comprised in a respective motor vehicle, wherein each of the at least one announcement receiver is configured to:

receive a first radio signal from the interception transmitter; and receive a second radio signal from the announcement transmitter, wherein the data processor is configured to:

obtain a position of the announcement transmitter;

determine a current velocity of the announcement transmitter;

for each announcement receiver of the at least one announcement receiver:

estimate a current velocity of the motor vehicle comprising the announcement receiver;

determine a relative velocity between the announcement transmitter and the motor vehicle comprising the announcement receiver, based on the current velocities;

determine an interception transmission distance corresponding to the distance from the position of the announcement transmitter to the most distant point on the periphery of the interception area, based on a preset warning time, a looping time and the relative velocity, wherein the preset warning time is indicative of the minimum time from the time instance that the announcement receiver receives the second radio signal until the time instance that the position of the announcement receiver corresponds to the position of the announcement transmitter, and wherein the looping time corresponds to a time that it takes for the interception transmitter to transmit the first radio signal multiplied by the number of frequencies to which the interception transmitter is assigned to broadcast;

determine an announcement transmission distance corresponding to the distance from the position of the announcement transmitter to the most distant point on the periphery of the announcement area based on an announcement time indicative of the length of the announcement to be transmitted, the relative velocity and the interception transmission distance, wherein the announcement transmission distance is greater than the interception transmission distance; and estimate a position of the motor vehicle comprising the announcement receiver;

receive, from the input signal receiver, an input signal;

determine a first field strength of the input signal, at a first frequency at the position of the motor vehicle comprising the announcement receiver;

determine a first transmission power of the first radio signal needed to suppress the input signal at the interception transmission distance, based on at least one of:

the interception transmission distance;

the attenuation of a transmitted radio signal over the interception transmission distance;

the first field strength, of the input signal at the position of the motor vehicle comprising the announcement receiver; and a predetermined suppression level;

determine a second field strength of at least one of:

atmospheric noise received from the input signal receiver; and the input signal at a second frequency, at the position of the motor vehicle comprising the announcement receiver and determine a second transmission power of the second radio signal, based on at least one of:

the announcement transmission distance;

the attenuation of a transmitted radio signal over the announcement transmission distance;

the second field strength; and a predetermined signal quality threshold value.

2. The system of claim 1, wherein the system is configured to repeatedly determine the first transmission power of the interception transmitter and the second transmission power of the announcement transmitter.

3. The system of claim 1, wherein the current velocity of the motor vehicle comprising the announcement receiver is estimated based at least on the current velocity of the announcement transmitter.

4. The system of claim 1, wherein the data processor is further configured to:

obtain speed limit data indicative of the speed limit associated with the position of the announcement transmitter; and estimate the current velocity of the motor vehicle comprising the announcement receiver based at least on the obtained speed limit data.

5. The system of claim 1, wherein the data processor is configured to identify the frequencies on which a radio channel or program is being broadcast at the time for transmitting the warning message or announcement by, for each frequency in the input signal:

comparing a value corresponding to the signal strength, the field strength or the signal quality of the frequency to a threshold value; and determining that the frequency belongs to the group of frequencies on which a radio channel or program is currently being broadcast if the value is equal to or higher than the threshold value.

6. The system of claim 1, wherein the data processor is configured to, for each of the at least one interception transmitter, control the interception transmitter to transmit the first radio signal at each of the frequencies on which a radio channel or program is being broadcast at the time for transmitting the warning message or announcement in sequence.

7. The system of claim 6, wherein the system comprises more than one interception transmitters, wherein the data processor is configured to:

divide the frequencies on which a radio channel or program is being broadcast into groups, wherein the number of groups corresponds to the number of interception transmitters, and wherein each of the frequencies on which a radio channel or program is being broadcast is included in one of the groups of frequencies; and control each of the interception transmitters to transmit the first radio signal at the frequencies comprised in a respective group of frequencies.

8. The system of claim 7, wherein the data processor is configured to optimize the grouping of the frequencies and assignment of frequency groups based on the signal strength or field strength of the respective frequencies on which a radio channel or program is being broadcast, the warning time, and the time of the respective interception transmitter, such that the overall output or transmission power needed to transmit the interception signal onto all frequencies on which a radio channel or program is being broadcast at the time for transmitting the warning message or announcement, using the at least two interception transmitters, is minimized.

9. The system of claim 1, wherein the system is configured, before controlling the one or more announcement transmitter to transmit the announcement signal, trigger the respective at least one announcement receiver to tune into the second frequency.

10. A method for determining output transmission power for radio signal transmission, from an interception transmitter and from an announcement transmitter respectively, to at least one announcement receiver, wherein each announcement receiver is comprised in a respective motor vehicle, the method comprising:

obtaining, by a data processor communicatively coupled to the announcement transmitter and the interception transmitter, a position of the announcement transmitter;

determining, by the data processor a current velocity of the announcement transmitter;

for each of the at least one announcement receiver:

estimating, by the data processor, a current velocity of the motor vehicle comprising the announcement receiver;

determining, by the data processor, a relative velocity between the announcement transmitter and the motor vehicle comprising the announcement receiver, based on the current velocities;

determining, by the data processor, an interception transmission distance, based on a preset warning time, a looping time and the relative velocity, wherein the preset warning time is indicative of the time from the time instance that the announcement receiver receives the second radio signal until the time instance that the position of the announcement receiver corresponds to the position of the announcement transmitter, and wherein the looping time corresponds to a time that it takes for the interception transmitter to transmit the first radio signal multiplied by the number of frequencies to which the interception transmitter is assigned to broadcast;

determining, by the data processor, an announcement transmission distance, based on a preset announcement time indicative of the length of the announcement to be transmitted, the relative velocity and the interception transmission distance, wherein the announcement transmission distance is greater than the interception transmission distance; and estimating a position of the motor vehicle comprising the announcement receiver;

receiving from an input signal receiver, in the data processor, an input signal;

determining, by the receiver or the data processor a first field strength of the input signal, at a first frequency, at the position of the motor vehicle comprising the announcement receiver;

determining, by the data processor, a first transmission power of the first radio signal needed to suppress the input signal at the interception transmission distance, based on at least one of:

the interception transmission distance;

the attenuation of a transmitted radio signal over the interception transmission distance;

the first field strength of the input signal; and a predetermined suppression level;

determining, by the data processor, a second field strength of at least one of:

atmospheric noise received from the input signal receiver; and the input signal at a second frequency, at the position of the motor vehicle comprising the announcement receiver; and determining, by the data processor, a second transmission power of second radio signal, based on at least one of:

the announcement transmission distance;

the attenuation of a transmitted radio signal over the announcement transmission distance;

the second field strength; and a predetermined signal quality threshold value.

11. The method of claim 10, comprising repeatedly determining, by the data processor, the first transmission power of the interception transmitter and the second transmission power of the announcement transmitter.

12. The method of claim 10, further comprising obtaining, by the data processor speed limit data indicative of the speed limit associated with the position of the announcement transmitter; and estimating the current velocity of the motor vehicle comprising the announcement receiver based at least on the obtained speed limit data.

13. The method of claim 10, further comprising identifying, by the data processor 104, the frequencies on which a radio channel or program is being broadcast at the time for transmitting the warning message or announcement by:

for each frequency in the input signal:

comparing, by the data processor, a value corresponding to the signal strength, the field strength or the signal quality of the frequency to a threshold value; and determining, by the data process, that the frequency belongs to the group of frequencies on which a radio channel or program is currently being broadcast if the value is equal to or higher than the threshold value.

14. The method of claim 13, further comprising, for each of the at least one interception transmitter:

controlling, by the data processor the interception transmitter to transmit the first radio signal at each of the frequencies on which a radio channel or program is being broadcast at the time for transmitting the warning message or announcement in sequence.

15. The method of claim 10, wherein more than one interception transmitter is used and wherein the method further comprises:

dividing, by the data processor, the frequencies on which a radio channel or program is being broadcast into groups, wherein the number of groups corresponds to the number of interception transmitters, and wherein each of the frequencies on which a radio channel or program is being broadcast is included in one of the groups of frequencies; and controlling, by the data processor, each of the interception transmitters to transmit the first radio signal at the frequencies comprised in a respective group of frequencies.

16. The method of claim 15, further comprising optimizing, by the data processor, the grouping of the frequencies and assignment of frequency groups based on the signal strength or field strength of the respective frequencies on which a radio channel or program is being broadcast, the warning time, and the time of the respective interception transmitter, such that overall output or transmission power needed to transmit the interception signal onto all frequencies on which a radio channel or program is being broadcast at the time for transmitting the warning message or announcement, using the at least two interception transmitters is minimized.

17. The method of claim 10, further comprising, before controlling the one or more announcement transmitter to transmit the announcement signal, trigger, by the data processor the respective at least one announcement receiver to tune into the second frequency.

18. A computer program loadable into a non-transitory memory communicatively connected or coupled to at least one data processor, comprising software for executing the method of claim 10 when the program is run on the at least one data processor.

19. A non-transitory processor-readable medium, having a program recorded thereon, where the program is to make at least one data processor execute the method according to claim 10 when the program is loaded into the at least one data processor.

* * * * *